US012492628B2

(12) United States Patent
Solem

(10) Patent No.: US 12,492,628 B2
(45) Date of Patent: Dec. 9, 2025

(54) CONTROLLING A DOWNHOLE TOOL

(71) Applicant: Odfjell Technology Invest LTD, Kokstad (NO)

(72) Inventor: Jonas Solem, Dubai (AE)

(73) Assignee: Odfjell Technology Invest Ltd., Kokstad (NO)

( * ) Notice: Subject to any disclaimer, the term of this patent is extended or adjusted under 35 U.S.C. 154(b) by 0 days.

(21) Appl. No.: 18/684,684

(22) PCT Filed: Aug. 23, 2022

(86) PCT No.: PCT/EP2022/073464
§ 371 (c)(1),
(2) Date: Feb. 18, 2024

(87) PCT Pub. No.: WO2023/025789
PCT Pub. Date: Mar. 2, 2023

(65) Prior Publication Data

US 2024/0368979 A1 Nov. 7, 2024

(30) Foreign Application Priority Data

Aug. 23, 2021 (GB) ..... 2112082

(51) Int. Cl.
*E21B 44/00* (2006.01)
*E21B 21/08* (2006.01)

(52) U.S. Cl.
CPC ..... *E21B 44/00* (2013.01); *E21B 21/08* (2013.01)

(58) Field of Classification Search
CPC ..... E21B 44/00; E21B 21/08; E21B 47/16; E21B 47/18; E21B 47/12; H03M 1/50
See application file for complete search history.

(56) References Cited

U.S. PATENT DOCUMENTS 2,811,210 A 10/1957 Guillot
2,857,141 A 10/1958 Carpenter
(Continued)

FOREIGN PATENT DOCUMENTS

AU 2017261539 A1 12/2017
CN 2521386 Y 11/2002
(Continued)

OTHER PUBLICATIONS

International Search Report, PCT/EP2022/076725, EPO (Dec. 6, 2022).
(Continued)

*Primary Examiner* — James G Sayre
(74) *Attorney, Agent, or Firm* — Wright IP & International Law; Eric G. Wright

(57) ABSTRACT

A method, apparatus and machine readable instructions for controlling a downhole tool are provided. An operational parameter of a drill string associated with the downhole tool is sensed to detect a number of pulses of the operational parameter within a time window having a predetermined duration. The pulses correspond to a period during which the operational parameter deviates from a baseline value and the detection of the number of pulses accommodates at least one of a variable pulse duration and a variable pulse magnitudes within the time window. A control command to control the downhole tool is executed depending on the detected number of pulses of the operational parameter.

20 Claims, 9 Drawing Sheets

(56) References Cited

U.S. PATENT DOCUMENTS

| | | | | |
|---|---|---|---|---|
| 3,737,845 | A * | 6/1973 | Maroney | E21B 47/13 340/12.18 |
| 4,406,335 | A | 9/1983 | Koot | |
| 4,421,182 | A | 12/1983 | Moody et al. | |
| 4,452,307 | A | 6/1984 | Horton | |
| 4,483,394 | A | 11/1984 | Peppers et al. | |
| 4,809,779 | A | 3/1989 | Ledyashov et al. | |
| 4,842,062 | A | 6/1989 | Schneider et al. | |
| 5,730,222 | A | 3/1998 | Rike, Jr. | |
| 5,819,353 | A | 10/1998 | Armell et al. | |
| 5,901,796 | A | 5/1999 | McDonald | |
| 6,152,221 | A | 11/2000 | Carmichael et al. | |
| 6,182,754 | B1 | 2/2001 | Vermeeren | |
| 6,401,813 | B1 | 6/2002 | Carmichael et al. | |
| 6,520,255 | B2 | 2/2003 | Tolman et al. | |
| 6,543,532 | B2 | 4/2003 | Estep et al. | |
| 7,055,605 | B2 | 6/2006 | Howlett et al. | |
| 7,322,419 | B2 | 1/2008 | Carmichael | |
| 7,347,288 | B2 | 3/2008 | Lee | |
| 7,348,893 | B2 | 3/2008 | Huang et al. | |
| 7,735,581 | B2 | 6/2010 | Beylotte et al. | |
| 7,766,086 | B2 | 8/2010 | Mondelli et al. | |
| 7,934,559 | B2 | 5/2011 | Posevina et al. | |
| 8,356,671 | B2 | 1/2013 | Guillory et al. | |
| 8,657,018 | B2 | 2/2014 | Cravatte | |
| 8,789,579 | B2 | 7/2014 | Ollerenshaw et al. | |
| 9,382,769 | B2 | 7/2016 | Wilson et al. | |
| 9,453,381 | B2 | 9/2016 | Moyes | |
| 9,631,432 | B2 | 4/2017 | Downton | |
| 9,951,612 | B2 | 4/2018 | Brown-Kerr et al. | |
| 10,041,335 | B2 | 8/2018 | Purkis | |
| 10,227,826 | B2 | 3/2019 | Odell, II et al. | |
| 10,352,155 | B2 | 7/2019 | Wilson et al. | |
| 10,526,871 | B2 | 1/2020 | Tzallas et al. | |
| 10,989,024 | B2 | 4/2021 | Fripp et al. | |
| 12,098,616 | B2 | 9/2024 | Solem | |
| 2001/0022223 | A1 | 9/2001 | Howlett | |
| 2002/0104649 | A1 | 8/2002 | Allen | |
| 2005/0056429 | A1 | 3/2005 | Du et al. | |
| 2005/0133220 | A1 | 6/2005 | Bishop | |
| 2005/0241856 | A1 | 11/2005 | Lassoie et al. | |
| 2006/0225920 | A1 | 10/2006 | Treviranus et al. | |
| 2007/0095573 | A1 | 5/2007 | Telfer | |
| 2008/0007423 | A1 | 1/2008 | Krueger et al. | |
| 2009/0025927 | A1 | 1/2009 | Telfer | |
| 2009/0169319 | A1 | 7/2009 | Hart | |
| 2009/0218092 | A1 | 9/2009 | Booth | |
| 2009/0266609 | A1 | 10/2009 | Hall et al. | |
| 2010/0089583 | A1 | 4/2010 | Xu et al. | |
| 2010/0243257 | A1 | 9/2010 | Krieg et al. | |
| 2011/0186355 | A1 | 8/2011 | Telfer | |
| 2011/0214873 | A1 | 9/2011 | Krieg et al. | |
| 2011/0278017 | A1 | 11/2011 | Themig et al. | |
| 2011/0284233 | A1 | 11/2011 | Wu et al. | |
| 2012/0048619 | A1 | 3/2012 | Seutter et al. | |
| 2013/0192818 | A1 | 8/2013 | Winn et al. | |
| 2013/0205523 | A1 | 8/2013 | Palmer | |
| 2013/0248249 | A1 | 9/2013 | Xu | |
| 2013/0319767 | A1 | 12/2013 | Wilson et al. | |
| 2014/0116712 | A1 | 5/2014 | Bansal et al. | |
| 2015/0021016 | A1 | 1/2015 | Deng et al. | |
| 2015/0027713 | A1 | 1/2015 | Penisson | |
| 2015/0027780 | A1 | 1/2015 | Hern et al. | |
| 2015/0041148 | A1 | 2/2015 | Greenan | |
| 2015/0068763 | A1 | 3/2015 | Jepp et al. | |
| 2015/0114665 | A1 | 4/2015 | Hora et al. | |
| 2017/0016292 | A1 | 1/2017 | Solem | |
| 2019/0136674 | A1* | 5/2019 | Fripp | E21B 43/12 |
| 2019/0169945 | A1 | 6/2019 | Orban et al. | |
| 2020/0024917 | A1 | 1/2020 | Angman et al. | |
| 2020/0024929 | A1 | 1/2020 | Arabskyy et al. | |
| 2020/0248531 | A1 | 8/2020 | Walton et al. | |
| 2021/0164344 | A1 | 6/2021 | Wilson et al. | |
| 2022/0243556 | A1 | 8/2022 | Boyle | |
| 2023/0167698 | A1 | 6/2023 | Hern et al. | |
| 2023/0250706 | A1 | 8/2023 | Mair | |
| 2023/0358114 | A1 | 11/2023 | Dyck | |

FOREIGN PATENT DOCUMENTS

| | | | |
|---|---|---|---|
| CN | 204571937 | U | 8/2015 |
| CN | 205591887 | U | 9/2016 |
| CN | 205823237 | U | 12/2016 |
| EP | 0201297 | B1 | 10/1993 |
| EP | 0787888 | B1 | 3/2005 |
| EP | 1177366 | B1 | 3/2005 |
| EP | 2279327 | B1 | 10/2013 |
| GB | 2336612 | A | 10/1999 |
| GB | 2411919 | A | 9/2005 |
| GB | 2411920 | A | 9/2005 |
| GB | 2544136 | A | 5/2017 |
| WO | 9954590 | A1 | 10/1999 |
| WO | 0107752 | A1 | 2/2001 |
| WO | 0235055 | A1 | 5/2002 |
| WO | 03087526 | A1 | 10/2003 |
| WO | 2004022907 | A1 | 3/2004 |
| WO | 2004067908 | A1 | 8/2004 |
| WO | 2004088091 | A1 | 10/2004 |
| WO | 2006016102 | A1 | 2/2006 |
| WO | 2007003894 | A2 | 1/2007 |
| WO | 2007060449 | A2 | 5/2007 |
| WO | 2009151786 | A2 | 12/2009 |
| WO | 2010015861 | A2 | 2/2010 |
| WO | 2010048167 | A2 | 4/2010 |
| WO | 2012100259 | A2 | 7/2012 |
| WO | 2013131194 | A1 | 9/2013 |
| WO | 2014186415 | A9 | 11/2014 |
| WO | 2015150212 | A2 | 10/2015 |
| WO | 2018122543 | A1 | 7/2018 |
| WO | 2018145215 | A1 | 8/2018 |
| WO | 2019155074 | A1 | 8/2019 |

OTHER PUBLICATIONS

Patents Act 1977: Search Report Under Section 17, GB2114212.0, IPO (Jun. 25, 2022).

Patents Act 1977: Combined Search And Examination Report Under Sections 17 and 18(3), GB2112082.9, IPO (Apr. 27, 2022).

International Search Report, PCT/EP2020/059639, EPO (Nov. 9, 2020).

International Search Report, PCT/EP2019/053345, EPO (Jul. 1, 2019).

Patents Act 1977: Search Report Under Section 17, GB1802223.6, IPO (Jun. 22, 2018).

International Search Report, PCT/EP2015/056540, EPO (Jan. 15, 2016).

Patents Act 1977: Search Report Under Section 17(5), GB1509015.2, IPO (Sep. 8, 2015).

Patents Act 1977: Search Report Under Section 17(5), GB1405967.9, IPO (Sep. 23, 2014).

Schlumberger Limited (Slumberger N.V.), aka SLB, "Well Commander Ball-Activated Drilling Circulating Valve.", Feb. 23, 2024, https://www.slb.com/products-and-services/innovating-in-oil-and-gas/completions/fluids-and-tools/wellbore-cleaning-tools/circulating-tools/well-commander-ball-activated-drilling-circulating-valve#related-information.

International Search Report, PCT/EP2022/073464, EPO (Jan. 26, 2023).

International Preliminary Report On Patentability, PCT/EP2022/076725, EPO (Apr. 9, 2024).

International Preliminary Report On Patentability, PCT/EP2022/073464, EPO (Feb. 27, 2024).

Written Opinion Of The International Searching Authority, PCT/EP2022/073464, EPO (Mar. 2, 2023).

Written Opinion Of The International Searching Authority, PCT/EP2022/076725, EPO (Dec. 6, 2022).

International Preliminary Report On Patentability, PCT/EP2020/059639, EPO (Sep. 29, 2022).

(56) References Cited

OTHER PUBLICATIONS

International Preliminary Report On Patentability, PCT/EP2019/053345, EPO (Aug. 18, 2020).
Written Opinion Of The International Searching Authority, PCT/EP2019/053345, EPO (Jul. 1, 2019).
International Preliminary Report On Patentability, PCT/EP2015/056540, EPO (Oct. 4, 2016).
Written Opinion Of The International Searching Authority, PCT/EP2015/056540, EPO (Jan. 15, 2016).

* cited by examiner

CONTROLLING A DOWNHOLE TOOL

FIELD OF THE INVENTION

Downhole Tool Control Technology

CROSS-REFERENCE TO RELATED APPLICATIONS

This application is a US National Stage Entry of copending PCT Application No. PCT/EP2022/073464 titled "Controlling A Downhole Tool" filed Aug. 23, 2022.

INCORPORATION BY REFERENCE

This US National Stage Entry incorporates by reference in its entirety copending PCT Application No. PCT/EP2022/073464 titled "Controlling A Downhole Tool" filed Aug. 23, 2022.

This US National Stage Entry also incorporates by reference in its entirety GB 2112082.9 titled "Controlling A Downhole Tool" filed Aug. 23, 2021.

BACKGROUND

In industries such as the oil and gas industry drilling operations provide drilled wells to recover hydrocarbon reserves.

Drilling, completion, maintenance and extraction operations associated with such wells may involve the use of a wide variety of different equipment being run into the well on a drill string. Such equipment frequently includes mechanical downhole tools which can be controlled remotely from the Earth's surface, for example, the tools may be controlled to activate different modes of the respective downhole tools depending a current stage of the drilling operation.

Controlling a downhole tool to invoke a desired mode of mechanical operation using conventional wired or wireless communication techniques may be difficult owing to the harsh downhole environment and the fact that it is deep underground. The present technique is applicable to any industry in which drilling operations are performed.

Previous solutions have attempted to overcome such difficulties by, for example, dropping objects such as a ball or a dart into a bore of the drill string to selectively block a bore of a downhole tool and apply a back pressure to actuate a mechanical mechanism of a tool.

A problem with downhole tools operable by selectively blocking a bore through the drill string in this way is that the bore is then unavailable for other operations. This can be addressed by blowing the ball or dart through the hole, but since a typical well can only tolerate a limited number of such objects being present in addition to the drill string, this in turn normally requires the ball or dart to be caught and retrieved, or drilled through.

A further problem with downhole tools operable by selectively blocking a bore through the drill string is that is it desirable to run in multiple tools on a single drill string, to minimise the number of trips. Where several tools share generally the same principle of actuation, such as the bore-blocking actuation described above, this may limit the number of tools that may be run in together, adding to overall time and cost of downhole operations.

Other previous solutions include using communication protocols reliant on, fixed, predetermined time slots, precisely controlling and measuring a rotational speed of a drill string or a pressure between an inside of the drill string and the outside (e.g., the annulus) of the drill string. Such solutions may have associated issues which render them inefficient and unreliable. For example, so-called "stick-slip" may give rise to fluctuations in the rotational speed of a drill string throughout its length, making precisely controlling its rotational speed challenging. As another example, precisely measuring a pressure difference between an inside and an outside of the drill string is complicated due to hydrostatic pressure varying with depth. Furthermore, utilising a communication protocol reliant on measuring certain parameters within a fixed, predetermined time slot may give rise to measurement errors due to latency in the system. Reduction of measurement errors at least in systems where predetermined time slots are used is desirable.

There remains a need for a means controlling a downhole tool that addresses or mitigates one or more of these issues.

BRIEF INTRODUCTION OF THE DRAWINGS

Example implementations are described below with reference to the accompanying drawings, in which:

FIG. 1 schematically illustrates an example drilling system in which a downhole tool may be controlled in accordance with the present technique;

FIG. 2 schematically illustrates an example control signal for controlling a downhole tool;

FIG. 3 schematically illustrates an example control signal for controlling a downhole tool where the control signal has a plurality of pulses with different polarities;

FIG. 4 schematically illustrates a further example control signal for controlling a downhole tool where the control signal has a plurality of pulses with different polarities;

FIG. 5 schematically illustrates an example controller for controlling a downhole tool;

FIG. 6 schematically illustrates an example downhole tool including an example controller;

FIG. 7 schematically illustrates a baseline sampling rate and a measurement sampling rate for sampling a control signal;

FIG. 8 schematically illustrates an example power source for powering a controller of a downhole tool;

DETAILED DESCRIPTION

Figure 1:
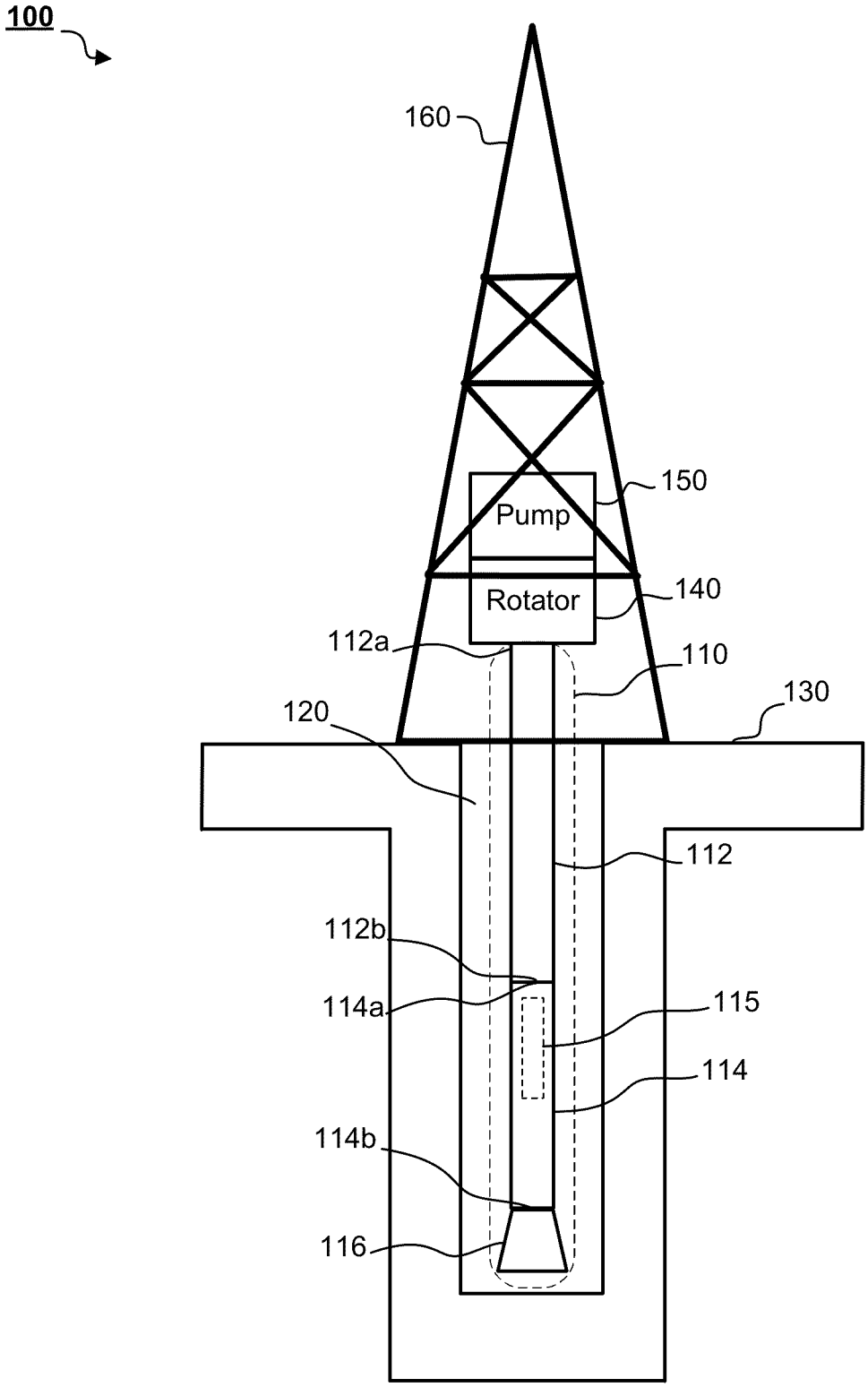

FIG. 1 schematically illustrates an example drilling system 100 in which a downhole tool may be controlled in accordance with the present disclosure. The drilling system 100 comprises a drill string 110 at least partially located in a wellbore 120 bored in the Earth 130; a drill string rotator 140, a drilling fluid pump 150, and a Derrick 160.

The drill string 110 comprises: a drill pipe 112; a downhole tool 114 comprising a controller 115; and a drill bit 116. The drill pipe 112 may have a first end 112*a* mechanically coupled to the drill string rotator 140 and a second end 112*b*, opposite the first end 112*a*, mechanically coupled to a first end 114*a* of the downhole tool 114. The downhole tool 114 may have a second end 114*b*, opposite the first end 114*a*, mechanically coupled to the drill bit 116. The term "mechanically coupled" encompasses both a direct and an indirect coupling between those elements which are described as being mechanically coupled to each other. For example, the first end 112*a* of the drill pipe 112 may be either directly or indirectly mechanically coupled to the drill string rotator 140. In examples where the first end 112*a* of the drill pipe 112 is indirectly mechanically coupled to the drill string rotator 140, there may be, for example, one or more components located between the first end 112*a* of the drill pipe 112 and the drill string rotator, such as, for example, one or more of: heavy weight drill pipe(s); drill collar(s); stabiliser(s); drilling jar(s); any other conventional drilling system components; and any combination thereof. Similarly, in some examples, there may be one or more components located between any one or more of: the second end 112*b* of the drill pipe 112 and the first end 114*a* of the downhole tool 114; and the second end of the downhole tool 114*b* and the drill bit 116.

The Derrick 160 is a support structure which supports the drill string 110, the drill string rotator 140, and the drilling fluid pump 150.

The drilling system 100 may drill the wellbore 120 by transmitting torque from the drill string rotator 140 to the drill bit 116 via the drill pipe 112. In doing so, the drilling system 100 may cause the drill bit 116 to rotate in a direction which results in the drill bit 116 cutting into, and removing drill cuttings from the Earth 130.

Drilling fluid (which may be known as "drilling mud") may be pumped, by the drilling fluid pump 150 through the drill string 110 and ejected from the drill bit 116. Doing so may serve to, for example, cool the drill bit 116 during drilling and to aid the removal of drill cuttings. Once ejected from the drill bit 116, the drilling fluid, along with drill cuttings suspended in the drilling fluid, may be pumped up an annular space between the drill string 110 and the sides of the wellbore 120 (not shown). Tools of the drill string such as the drill bit 116 may be arranged to allow expulsion of cuttings in various ways such as through an annular space or a plurality of nozzles.

The drill string rotator 140 may comprise any means for rotating the drill string 110, including, but not limited to: a rotary table; a "top drive"; and a "Kelly drive".

The downhole tool 114 may be a tool having one or more modes which an operator of the drilling system 100 can selectively activate to cause a desired action. As an illustrative example, the downhole tool 114 may comprise an underreamer having a plurality of retractable cutting blades which may be configured such that they are retracted in a deactivated mode and extended in an activated mode. In some examples, drilling may initially commence with the underreamer in the deactivated mode. As a result, the diameter of the wellbore 120 may correspond to the diameter of the drill bit 116. Subsequently, the operator of the drilling system 100 may desire to enlarge the diameter of the wellbore 120 in a region below the downhole tool 114. Accordingly, the operator of the drilling system 100 may invoke the activated mode of the underreamer, thereby causing its retractable cutting blades to transition to their extended position, in which they can drill a wellbore having an increased diameter.

The present disclosure is not limited to any type of downhole tool, and the downhole tool 114 may comprise any type of downhole tool, including but not limited to one of: a circulating sub; an underreamer; a casing scraper; a variable gauge stabiliser; a line hanger; a whipstock; a rotary steerable system; a drill string isolation tool; a jetting tool; a magnet; a filter; a swivel; a mill; a brush; a venturi; and a disconnect tool. The drill string may be, for example a casing string or a liner string or another type of drill string having one or more tools to be controlled, Controlling the downhole tool 114 to invoke a desired mode of the downhole tool 114 using conventional wired or wireless communication techniques may be difficult owing to the harsh downhole environment. Previous solutions have attempted to overcome such difficulties by, for example, using mechanical mechanisms reliant on balls or darts being dropped from the top of the wellbore. Other previous solutions include using communication protocols reliant on, during fixed, predetermined time slots, precisely controlling and measuring a rotational speed of a drill string or a pressure difference between the inside of a drill string and the outside (e.g., the annulus) of the drill string.

Such previous solutions may have associated issues which render them inefficient and unreliable. For example, so-called "stick-slip" may give rise to fluctuations in the rotational speed of the drill string 110 along its length, making precisely controlling its rotational speed challenging. As another example, precisely measuring the pressure difference between the inside and the outside of the drill string 110 may involve time consuming baseline measurements to account for e.g., hydrostatic pressure varying with depth. Furthermore, utilising a communication protocol reliant on measuring certain parameters within a predefined time slot having a fixed start time and end time may give rise to measurement errors due to latency in the system.

Advantageously, as will be discussed further below, the present technique may enable the downhole tool 114 to be controlled, via the controller 115, in a manner which is not reliant on, for example, precise measurements of either the rotational speed of the drill string 110 or pressure, and which is not as susceptible to errors due to latency.

The controller 115 may be implemented in any of hardware, software, firmware, or any combination thereof. In some examples, the controller 115 may comprise processing circuitry, such as, for example, a microcontroller, or any other type of processing circuitry. As will be discussed further below, the controller 115 is operable to control the downhole tool 114 responsive to detecting a control signal conveying a control command for the downhole tool 114. The control signal may be communicated to the controller 115 by modulating an operational parameter of the drill string 110 in accordance with the present technique. The operational parameter may comprise any parameter whose value can be selectively modulated by (e.g., an operator) operating the drill string 110. For example, the operational parameter may comprise any one of: a rotational speed of the drill string in Revolutions per Minute (RPM); a pressure of fluid in the drill string in pascals or psi (pounds per square inch); a flow rate of fluid through the drill string in cubic metres per second; a longitudinal axial movement of the drill string in metres; or any other operational parameter of a drill string. It will be appreciated that the units of measurement may be other than as stated. In the case of the operational parameter being a pressure then the baseline value may correspond to a hydrostatic pressure.

While a downhole tool—the downhole tool 114—is shown in FIG. 1, this is merely one illustrative example and the present disclosure is not so limited. In other examples, the drill string 110 may comprise a plurality of mechanically exchangeable downhole tools and the present technique may be applicable for controlling one or more downhole tools of the plurality downhole tools comprised within the drill string 110.

The drilling system 100 illustrated in FIG. 1 has been simplified for the sake of clarity, and the drilling system 100 may comprise conventional components of drilling systems not shown in FIG. 1, including but not limited to, for example: heavy weight drill pipe(s), drill collar(s), stabiliser(s), drilling jar(s), any other conventional drilling system components, or any combination thereof.

Figure 2:
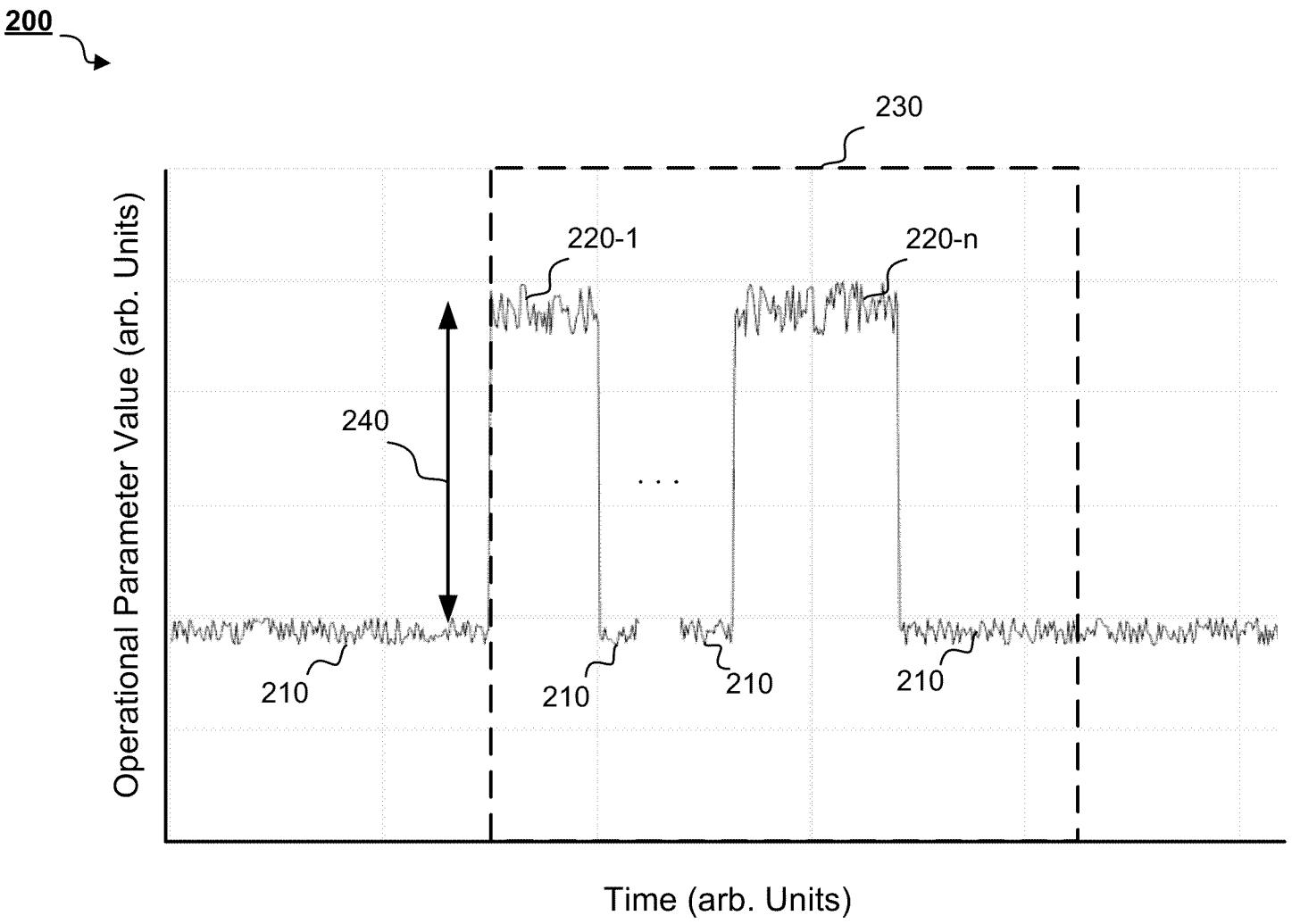

FIG. 2 schematically illustrates an example control signal 200 for controlling a downhole tool comprised within a drill string, such as the drill string 110 shown in FIG. 1, for example. The downhole tool may comprise, for example, the downhole tool 114 shown in FIG. 1, or any other downhole tool comprising or otherwise communicatively coupled to a controller, such as the controller 115 shown in FIG. 1, for example, operable to control the downhole tool in accordance with the present technique.

The control signal 200 comprises a number of pulses 220-1 to **220-*n* (where n is any integer value of one or greater) of an operational parameter of the drill string within a time window 230 having a predetermined duration but flexible start time (and thus end time). Accordingly, the control signal 200 may comprise any positive non-zero integer number of pulses within the time window 230**.

The control signal 200 may convey a particular control command for the downhole tool based on the number of pulses of the operational parameter present within the time window 230. In the example control signal 200 shown in FIG. 2, a start of the time window 230 corresponds to the start (e.g., the rising edge) of the first pulse 220-1. As will be discussed further below, the present disclosure is not so limited, however, and the start of the time window 230 may correspond to, for example, other features present in a control signal. Triggering the beginning of the time window 230 depending on the detected occurrence of a pulse in the control signal provides resilience against any drift in value of the operational parameter over time that might otherwise result in a baseline measurement being performed during a pulse.

Referring back to FIG. 2, there may be a mapping between the number of pulses 220-1 to **220-*n* of the operational parameter within the time window 230 and a corresponding control command. As an illustrative example, if the control signal 200 were to comprise only one pulse within the time window 230, the control signal 200 may correspond to a first control command of the downhole tool, whereas if the control signal 200 were to comprise two pulses within the time window 230 (i.e., if n were equal to 1), the control signal 200** may correspond to a second control command, different from the first control command.

In some examples, the mapping between the number of pulses within the time window 230 and the corresponding control command may be based on an absolute number of pulses within the time window 230 and may not depend on, for example, the absolute magnitude or absolute duration of any of the pulses within the time window 230, or the time at which they occur relative to the time window 230. Accordingly, one or more of the following may be variable: a duration of (e.g., each of or a subset of) the constituent pulses in the time window 230; the magnitude of (e.g., each of or a subset of) the constituent pulses in the time window 230; and the (e.g., temporal) position of (e.g., each of or a subset of) the constituent pulses in time window 230. Thus, unless otherwise stated, the constituent pulses of the operational parameter in the control signal 200 may have any magnitude (e.g., over a threshold magnitude) and any duration, and may occur at any time within the time window 230. If a pulse has a duration that extends beyond an end of the time window it may not be counted. Accordingly, communicating the control signal 200 to the controller 115 of the downhole tool 114 via a user at a data processing device (not shown) at the Earth's surface controlling the rotation speed of the drill pipe to modulate it on and off or fast and slow or by altering pump characteristics to cause a change in pressure, in either case measurable via a sensor (e.g. gyroscope or pressure sensor) located somewhere on the drill string may not require the precise modulation of the operational parameter with respect to any of magnitude, duration, or absolute temporal position.

According to the present technique an asynchronous communication method is used in which a total number of pulses in a predetermined time duration is measured. This is feasible because the communication protocol is one way, which is from the user to the controller 115, the communication being performed by modifying angular rotation or pressure using the pump 150 or the rotator 140 at the Earth's surface. There is no return path from the controller 115 to the user and this makes sense due to the difficulties of communicating either via a wired connection or a wireless connection in the harsh downhole environment. By way of contrast, in bidirectional communication protocols, synchronous communication is often used involving clocking or precision timing to transmit binary bits. For such synchronous communication since the data may be sampled on, say, a rising edge of the clock signal, a change in the pulse width can result in a different pulse count for a given pulse signal due to the nature of the sampling technique. This is because a wider pulse can be counted more than once depending on the sampling frequency. In particular, if the pulse width is greater than the sampling period defined by the clock signal then that pulse may be counted more than once. Thus synchronous communication methods are more error prone when the pulse signal being monitored has pulses likely to have variations in pulse width. Variations in the pulse width are expected in the downhole environment. Indeed, there is an inherent variability in pulse transmission associated with both the pump 150 and the rotator 140. For this reason, counting the total number of pulses in a predetermined time window is more accurate than a binary sampling based on a rising or falling edge of a clock signal.

A control command conveyed by the control signal 200 may comprise any control command for the downhole tool, including, but not limited to a command putting the tool into: an activated mode, which may be one of a plurality of activated modes; a deactivated mode, which may be one of a plurality of deactivated modes; a delayed activation mode, which may be one of a plurality of delayed activation modes; a delayed deactivation mode, which may be one of a plurality of delayed deactivation modes; and an isolation mode, which may be one of a plurality of isolation modes.

In some examples, the control command conveyed by the control signal 200 may invoke a first mode of a plurality of modes of the downhole tool. For example, there be a mapping between that control command and a particular mode of the downhole tool. In other examples, the control command conveyed by the control signal 200 may invoke a transition from a current mode of a plurality of modes of the downhole tool to a different mode of the plurality of modes of the downhole tool. As an illustrative example, when the downhole tool is in e.g., a deactivated mode, a given control command conveyed by the control signal 200 may invoke a transition to an activated mode of the downhole tool. Continuing with the same illustrative example, when the downhole tool is in e.g., an activated mode, the same given control command conveyed by the control signal 200 may invoke a transition to a deactivated mode of the downhole. Thus a given command may invoke a mode transition, an outcome of which depends on a current mode of the tool when the command is received.

In examples where a control command conveyed by the control signal 200 invokes a transition from a current mode to a different mode of the plurality of modes of the downhole tool, the different mode may be predetermined depending on the current mode. For example, a controller operable to control the downhole tool in accordance with the present technique may store a state transition diagram and may invoke, responsive to the control signal 200, the different mode depending on the current mode in accordance with the state transition diagram. A pulse of an operational parameter may correspond to a temporary deviation of the operational parameter from a baseline value 210 to a value different from the baseline value 210. The baseline value may be represented by a baseline average over a time period rather than as a fluctuating value. The value different from the baseline value 210 corresponding to the deviation may comprise either: a value greater than the baseline value 210; or a value less than the baseline value 210. In other words, a pulse of an operational parameter may comprise either: a change in magnitude of the operational parameter from a baseline value to a value greater than the baseline value, followed by a change back to the baseline value 210 (subsequently referred to has a "positive pulse" or a pulse having a "positive polarity"); or a change in magnitude of the operational parameter from a baseline value to a value less than the baseline value, followed by change back to the baseline value (subsequently referred to as a "negative pulse" or a pulse having a "negative polarity"). Accordingly, while the pulses of the operational parameter shown in FIG. 2 are positive pulses, this is merely for illustrative purposes, and the present disclosure is not so limited. Unless otherwise stated, any control signal disclosed herein may comprise any combination of positive and negative pulses of an operational parameter of a drill string including exclusively positive pulses or exclusively negative pulses.

As will be discussed further below, to determine a control command of a downhole tool, a controller of (e.g., comprised within or otherwise communicatively coupled to) the downhole tool may sense an operational parameter of a drill string comprising the downhole tool to detect a number of pulses of the operational parameter within a time window having a predetermined duration. An individual pulse of the number of pulses of the operational parameter may comprise both a first transition from a baseline value to a value different from the baseline value (e.g., a rising edge in the case of a positive pulse and a falling edge in the case of a negative pulse) and a second transition from substantially the value different from the baseline value to the baseline value (e.g., a falling edge in the case of a positive pulse and a rising edge in the case of a negative pulse). However, to count a number of pulses, it is possible to detect only a number of leading edges or only a number of falling edges rather than counting both leading and falling edges of each pulse. Any way of accurately determining a total number of pulses in the predetermined time window, regardless of variability in pulse duration, is consistent with the present technique.

Accordingly, detecting a pulse of a number of pulses of an operational parameter encompasses any one of: detecting the first transition from the baseline value to the value different from the baseline value associated with that pulse; detecting the second transition from substantially the value different from the baseline value to the baseline value associated with that pulse; detecting both the first and second transitions associated with that pulse; and any other method by which the presence of the pulse may be detected or inferred. Detecting a number of pulses of the operational parameter is not limited to any one detection method for detecting any one constituent pulse: each pulse of the number of pulses may be detected in the same or in different ways provided that switching between different pulse detection criteria does not compromise an accuracy of the pulse count.

As will be discussed further below, in some examples, a pulse of the operational parameter may be distinguished from, for example, baseline noise, by utilising a threshold. For example, a magnitude of the temporary deviation between the baseline value and the value different from the baseline value (i.e., magnitude deviation corresponding to the arrow 240 shown in FIG. 2) may exceed a predetermined pulse threshold value (also referred to as a baseline tolerance threshold). The pulse threshold value 240 may provide a lower bound for a magnitude of a deviation from the baseline value 210 that triggers a pulse count. The pulse count is implemented such that variability in pulse magnitude is accommodated. This means that any pulse deviating from a magnitude by more than the pulse threshold results in incrementing the pulse count. Some pulses that trigger a count may be greater in magnitude than other pulses that trigger a count. Similarly, the pulse count is accurate regardless of any variations in pulse duration. The first pulse 220-1 is of appreciably shorter duration than the second pulse **220-*n* and yet each pulse can result in an increment of one to the pulse count according to the present technique. This may be achieved via implementing the pulse threshold 240**. An ability to distinguish between a rising edge and a falling edge of the pulse can provide a resilience of the count such that it remains accurate despite potential variability in pulse widths. The identification of falling and rising edges as part of pulse detection can assist with compensating for any drift over time, such as a drift due to any temperature variation.

While in the example control signal 200 shown in FIG. 2 the start of a time window aligns 230 with the start of a first pulse 220-1, this is merely for illustrative purposes and the present disclosure is not so limited. As will be discussed further below, a controller operable to control a downhole tool in accordance with the present technique may determine the start of a time window in which to detect a number of pulses of the operational parameter based on, for example any one of: an earliest detected pulse of the operational parameter; and an earliest detected pulse of the operational parameter since an expiration of a previous time window during which a previous number of pulses of the operational parameter were detected. The time window may be selected to coincide with a beginning of a pulse (e.g. to detect a rising edge) or a point during a pulse (e.g. to detect a falling edge) or to start between pulses (e.g. to detect a next rising or falling edge). Alternatively, the time window may be set to occur periodically regardless of pulse characteristics or timing. For example, the tool may be activated every other hour or may be on for 5 minutes and off for 5 mins.

While the example first control signal shown 200 shown in FIG. 2 comprises pulses 220-1 to **220-*n* having the same polarity (e.g., the pulses 220-1 and 220-*n*** are positive pulses), the present disclosure is not so limited, and other example control signals may comprise pulses having different polarities. For example, an control signal according to the present technique may comprise any of: a plurality of pulses, each of which have a positive polarity; a plurality of pulses, each of which have a negative polarity; and a plurality of pulses, some of which have a positive polarity and some of which have a negative polarity.

Figure 3:
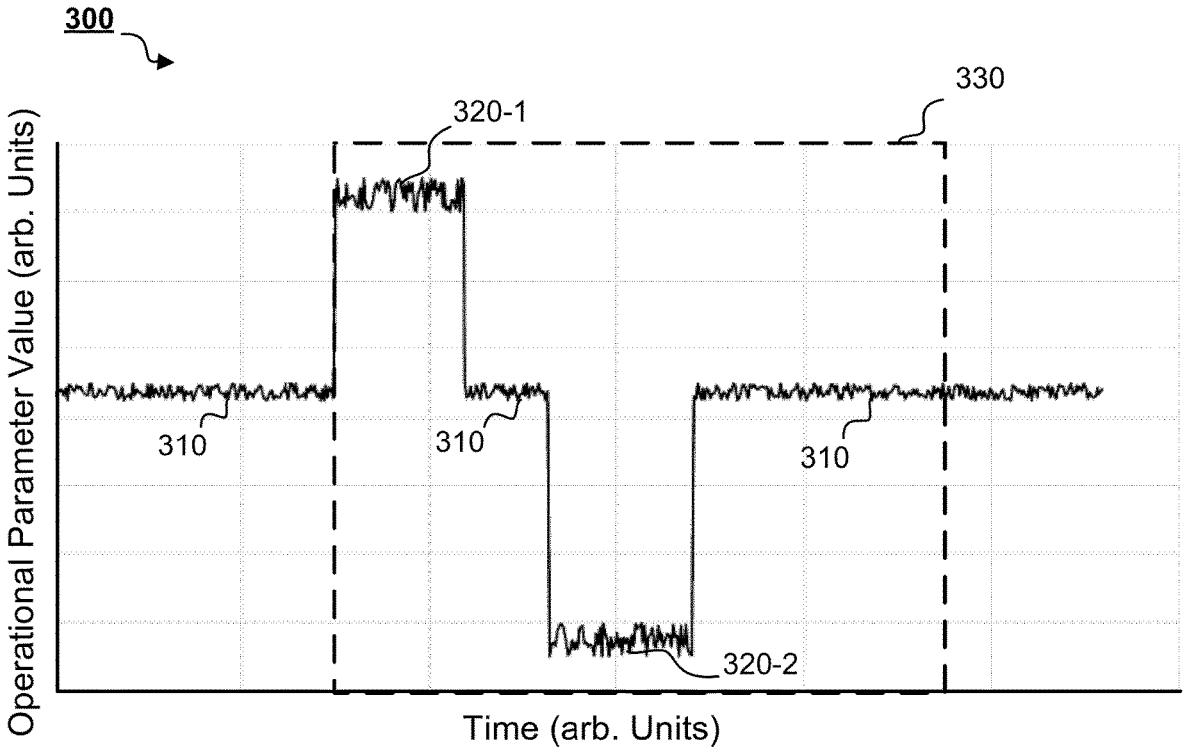
Figure 4:
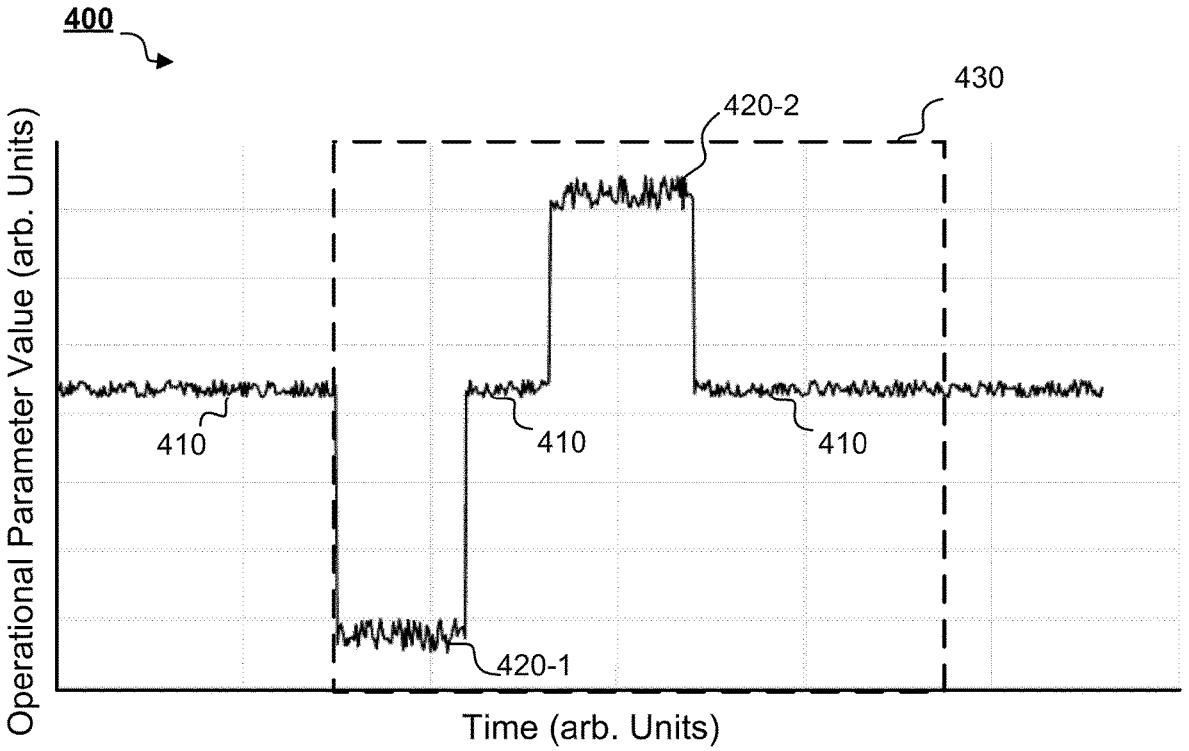

In examples where a control signal comprises a plurality of pulses having different polarities, such as a second control signal 300 as shown in FIG. 3 or a third control signal 400 shown in FIG. 4, a mapping between a number of pulses of the control signal within a time window and the corresponding control command may be based on an absolute number of pulses within the time window and may not depend on any one or more of: an absolute pulse magnitude (relative to a baseline or otherwise); a duration of any of the pulses within the time window; a time at which a pulse occurs relative to the time window; or the polarity of the pulse(s). In other examples, as will be discussed further below in relation to the second and third example control signals shown respectively in FIG. 3 and FIG. 4, a mapping between the number of pulses of an operational parameter within a time window of a control signal and a corresponding control command may depend on not just the number of constituent pulses, but also polarities of the pulse(s). In a further alternative example, the mapping between the number of pulses of the operational parameter and the corresponding control command may further depend on the order of the pulses in time with respect to their individual polarities.

FIG. 3 schematically illustrates the second example control signal 300 comprising pulses of an operational parameter having different polarities. The second example control signal 300 comprises a first pulse 320-1 of an operational parameter and a second pulse 320-2 of the same operational parameter within a time window 330 having a predetermined duration. The first pulse 320-1 comprises a temporary deviation of the operational parameter from a baseline value 310 to a value greater than the baseline value 310 and thus corresponds to a positive pulse. The second pulse 320-2 comprises a temporary deviation of the operational parameter from the baseline value 310 to a value less than the baseline value 310 and thus corresponds to a negative pulse.

FIG. 4 schematically illustrates the third example control signal 400 comprising pulses of an operational parameter and including pulses having different polarities. The third example control signal 400 comprises a first pulse 420-1 and a second pulse 420-2 of the same operational parameter within a time window 430 having a predetermined duration. It is convenient if the duration of the time window is arranged to exceed the largest anticipated pulse width in duration, or at least to exceed the average pulse width. The first pulse 420-1 is a negative pulse. The second pulse 420-2 is a positive pulse.

With reference to both FIGS. 3 and FIG. 4, in some examples, the command conveyed by a control signal, such as the second control signal 300 or the third control signal 400 may depend on an absolute number of pulses within a time window in addition the pulse polarities. For example, there may be a mapping between a given control command and a number of positive pulses and number of negative pulses within a time window. In some such examples, the mapping between the given control command and the number of pulses with respect to their polarity may depend the order of the constituent pulses with respect to their polarity. By way of illustration, in examples where a relative temporal ordering of pulses having different polarities does not determine which control command is implemented in response to the control signal, a controller operable to control a downhole tool in accordance with the present technique may determine the same control command from both the second example control signal 300 and the third example control signal 400 because both comprise one positive pulse and one negative pulse within their respective time windows. By way of contrast, in examples where a command conveyed by an control signal does depend on a temporal ordering order positive and negative pulses, a controller operable to control a downhole tool may determine different control commands from the second example control signal 300 and the third example control signal 400 because the relative order of their constituent positive and negative pulses differs. Utilising both a number of pulses of an operational parameter and their relative temporal ordering with respect to polarity may enable a more efficient mapping of control commands to pulses so that a higher number of commands may be uniquely mapped to a smaller number of pulses than would be the case of the relative temporal ordering was not taken into account in the mapping.

A control signal in accordance with the present technique may comprise any number of pulses of an operational parameter within a time window and is not limited to the two pulses of opposite polarities as illustrated in FIG. 3 and FIG. 4. The command conveyed by a control signal may depend on a number of pulses within the corresponding time window irrespective of pulse polarity or relative temporal orderings of any pulses having opposite polarities. In further examples, the command conveyed may depend on the number of positive and number of negative pulses regardless of temporal ordering. In yet further examples, the command conveyed may also depend on the relative temporal ordering of pulses having different polarities.

Figure 5:
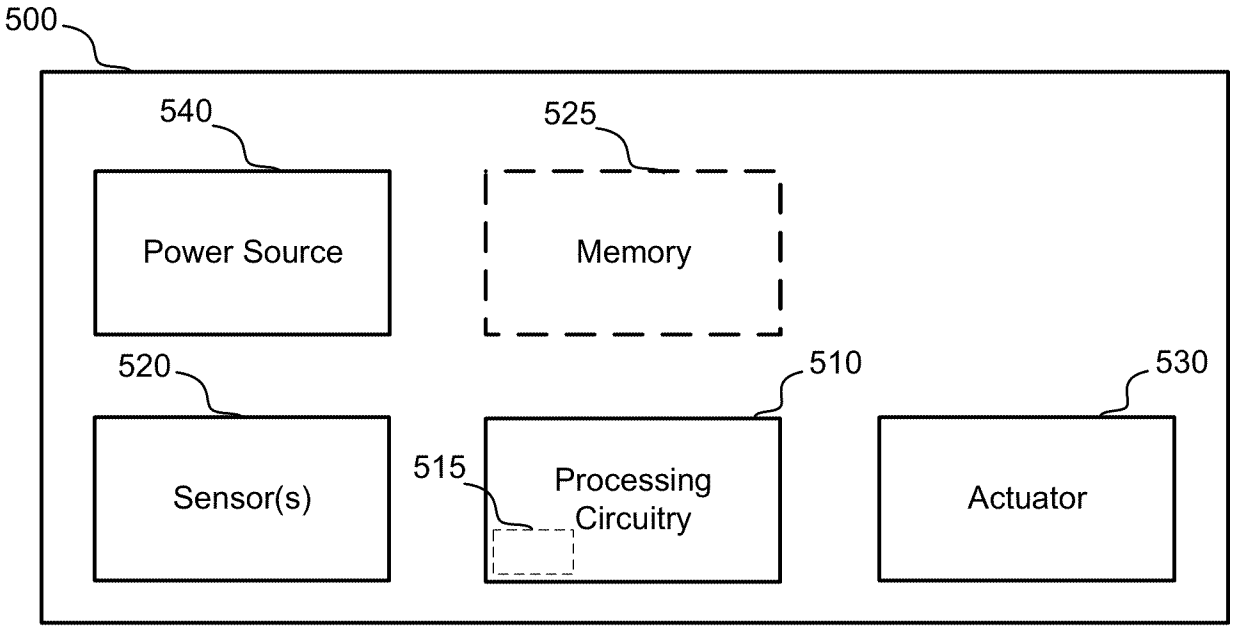

FIG. 5 schematically illustrates an example controller 500 for controlling a downhole tool, such as, for example, the downhole tool 114 shown in FIG. 1, or any other downhole tool. In some examples, the controller 500 may correspond to the controller 115 shown in FIG. 1.

Figure 6:
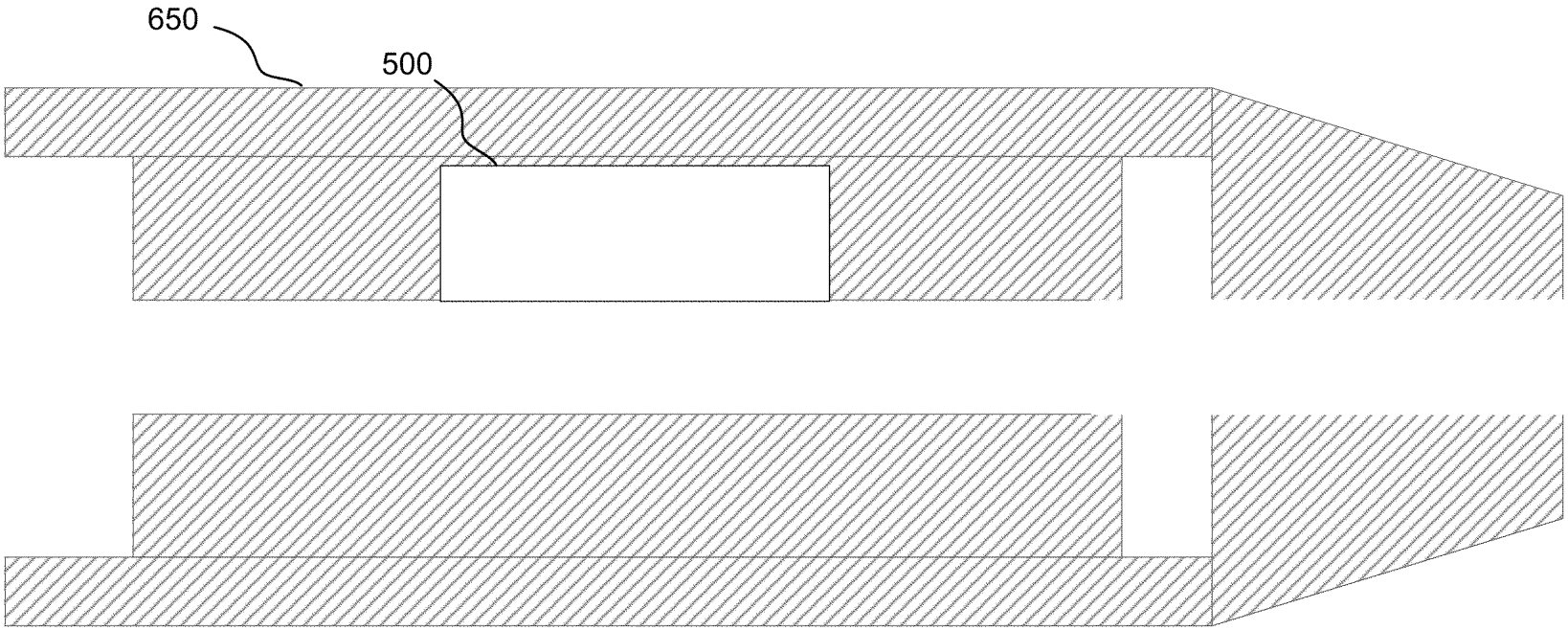

The controller 500 may be operably coupled to the downhole tool 114 to control it to perform a drilling operation. For example, the controller 500 may be located within a housing in the body of the downhole tool 114 or the drill pipe 112 or in a dedicated tool body (not illustrated). Such an example is shown in FIG. 6 which comprises the controller 500 and a downhole tool 650. The downhole tool 650 may comprise any downhole tool, such as: a circulating sub; an underreamer; a casing scraper; a variable gauge stabiliser; a line hanger; a whipstock; a rotary steerable system; a drill string isolation tool; a jetting tool; a magnet; a filter; a swivel; a mill; a brush; a venturi; and a disconnect tool. The controller 500 comprises processing circuitry 510, one or more sensors 520, an actuator 530, and a power source 540. In some examples, the processing circuitry 510 may comprise a memory 515, which is internal to the processing circuitry 510. Additionally or alternatively, the controller 500 may comprise a memory 525, which is external to the processing circuitry 510.

The one or more sensors 520 may be arranged to sense an operational parameter of the drill string comprising the downhole tool 650 to be controlled by the controller 500. The one or more sensors 520 may output an electrical signal, the value of which may correspond to a value of the operational parameter. The operational parameter of the drill string may be, for example, a rotational speed of the drill string 110; a pressure of fluid in the drill string 110; a flow rate of fluid through the drill string 110; and a longitudinal axial movement of the drill string 110.

The one or more sensors 520 may comprise any type or types of sensors operable to sense the operational parameter directly or indirectly. The sensors may be passive sensors or active sensors or a combination of these two types. In examples where the operational parameter comprises a rotational speed of the drill string 110, the one or more sensors 520 may comprise a rotational speed sensor-such as a gyroscope, an accelerometer, a tachometer, or any other type of rotational speed sensor-which may directly sense the rotational speed of the drill string. In other examples where the operational parameter comprises a rotational speed of the drill string, the one or more sensors 520 may indirectly sense the rotation of the drill string such as by sensing a vibration of the drill string 110, from which a modulation of its rotational speed may be inferred. The one or more sensors 520 may comprise any one of: a tachometer; an accelerometer; a hall effect sensor; a photoelectric sensor; a magnetometer; a gyroscope; a strain gauge; a pressure sensor; any other type of sensor capable of sensing the operational parameter of the drill string; and any combination thereof. Different sensors may be placed at different locations on the drill string 110 or downhole tool 114 as appropriate for the measurement being made.

The one or more sensors 520 may be communicatively coupled to the processing circuitry 510. In some examples, the output of the one or more sensors 520 may be an analogue output which may be converted to a corresponding digital value using an analogue to digital converter (ADC) (not shown). In these examples, the ADC may be one of: comprised within the one or more sensors 520 themselves; comprised within the processing circuitry 510; or external to both the one or more sensors 520 and the processing circuitry 510.

In some examples, the output of the one or more sensors 520 may be filtered (e.g., by one of a low pass filter, a rolling average filter, or any other type of filter operable to reduce noise) to reduce noise prior to the processing circuitry 510 detecting a number of pulses of an operational parameter based on the output of the one or more sensors 520. This filtering may be implemented any of hardware, software, firmware, or any combination thereof. In some examples, the filtering may be implemented by any one of: the one or more sensors 520 themselves; the processing circuitry 510; or by circuitry separate from the processing circuitry 510 (not shown).

The processing circuitry 510 may sample an output of at least a subset of the one or more sensors 520 to determine a number of pulses of the operational parameter in a time window having a predetermined duration. The value of the predetermined duration may be stored, for example, in the memory 515 or the memory 525. The processing circuity may have a counter (not shown) and may use a clock signal to perform time-based operations such as measuring the time window in which the pulses are detected and controlling a sampling period of sensor(s) measurements.

In some examples, responsive to detecting an earliest pulse of an operational parameter (e.g.), the processing circuitry may trigger a start of a time window, by, for example, starting a timer. The pulse may be an absolute earliest pulse detected by the processing circuitry 510 after the processing circuitry is powered up, or an earliest pulse since expiration of a previous time window during which a previous number of pulses of the operational parameter were determined. Upon expiration of the time window, the processing circuitry 510 may determine a number of pulses of the operational parameter within the time window and cause execution of a control command to control the downhole tool depending on the detected number of pulses of the operational parameter. The pulse count may be incremented by a counter during the time window to provide a final pulse count upon expiration of the time window. A mapping between the number of pulses of the operational parameter in the time window and a corresponding control command may be stored in, for example, the memory 515 or the memory 525. In some examples the mapping may optionally include a mapping between the number of pulses and their respective polarities (e.g., a number of positive pulses compared to a number of negative pulses) and a corresponding control command. In some examples, the mapping may further include a mapping between the number and order of the constituent pulses with respect to their polarity.

The processing circuitry 510 may cause activation of the control command by controlling the actuator 530, which may comprise, for example, an electromechanical solenoid, an electromagnet, a linear ball screw, a mechanical latch or any other type of actuator. In some examples, the processing circuitry 510 may control the actuator 530 via driver circuitry (not shown). The actuator may trigger activation of a new downhole tool or control an operation of a downhole tool already in use in the drill string 110. The drill string 110 may comprise a set of different downhole tools that are individually selectable via the actuator 530. All but a currently engaged tool may be retracted within the drill string 110. However, some tools may be non-retractable. In some examples, the processing circuitry 510 may distinguish a pulse of an operational parameter from, for example, baseline noise, by utilising a threshold. For example, where the processing circuitry 510 detects a pulse by detecting at least one transition between a baseline value and a value different from the baseline value, the processing circuitry 510 may compare a magnitude of a difference between the baseline value and the value different to the baseline value with a predetermined pulse threshold such as the threshold 240 illustrated in FIG. 2, and may increment a pulse counter when the magnitude of a given operational parameter exceeds the predetermined threshold. This predetermined pulse threshold may be stored in the memory 515 or the memory 525, for example. In some examples, the comparison between the magnitude of the difference between the baseline value and the value different to the baseline value may involve a comparison between two sampled data points output from the one or more sensors 520 or between two filtered data points based on sampled data points output from the one or more sensors 520.

In some examples, the processing circuitry 510 may periodically or intermittently recalibrate the baseline value. For example, the processing circuitry 510 may recalibrate the baseline value by periodically or intermittently determining either an average value to give a baseline average or a minimum value based on a predetermined number (e.g., stored in the memory 515 or the memory 525) of preceding samples of the operational parameter to give a baseline minimum. In these examples, drift in the baseline value may be distinguished from the presence of a pulse of an operational parameter comprised within a control signal by utilising a baseline tolerance threshold as described above. For example, if the output from the one or more sensors 520 (which may be filtered output) comprises a deviation from the baseline value exceeding the predetermined baseline tolerance threshold, the processing circuitry may recognise these data points as corresponding to a pulse of an operational parameter and may not use these data points for baseline recalibration purposes.

In some examples, the processing circuitry 510 may sample the output of the one or more sensors 520 with a sampling rate depending on whether or not the processing circuitry 510 has triggered the start of the time window. In other examples the sampling rate may be independent of the time windows during which pulses are counted to interpret control signals.

The processing circuitry 510 of FIG. 5 may be general purpose processor circuitry configured by program code to perform specified processing functions. The circuitry may alternatively be configured by modification to the processing hardware. Configuration of the circuitry to perform a specified function may be entirely in hardware, entirely in software or using a combination of hardware modification and software execution. Machine-readable instructions may be used to configure logic gates of general purpose or special-purpose processor circuitry to perform a processing function. The machine-readable instructions to implement the method of FIG. 9, for example, may be stored in at least one of the internal memory 515 and the external memory 525. Processing circuitry 510 may be implemented, for example, as a hardware circuit comprising custom Very Large Scale Integrated, VLSI, circuits or gate arrays, off-the-shelf semiconductors such as logic chips, transistors, or other discrete components. Circuitry 510 may also be implemented in programmable hardware devices such as field programmable gate arrays, FPGA, programmable array logic, programmable logic devices, a System on Chip, SoC, or the like.

Machine readable program instructions may be provided on a transitory medium such as a transmission medium or on a non-transitory medium such as a storage medium 515, 525. Such machine readable instructions (computer program code) may be implemented in a high level procedural or object oriented programming language. However, the program(s) may be implemented in assembly or machine language, if desired. In any case, the language may be a compiled or interpreted language, and combined with hardware implementations. Program instructions may be executed on a single processor or on two or more processors in a distributed manner.

Figure 7:
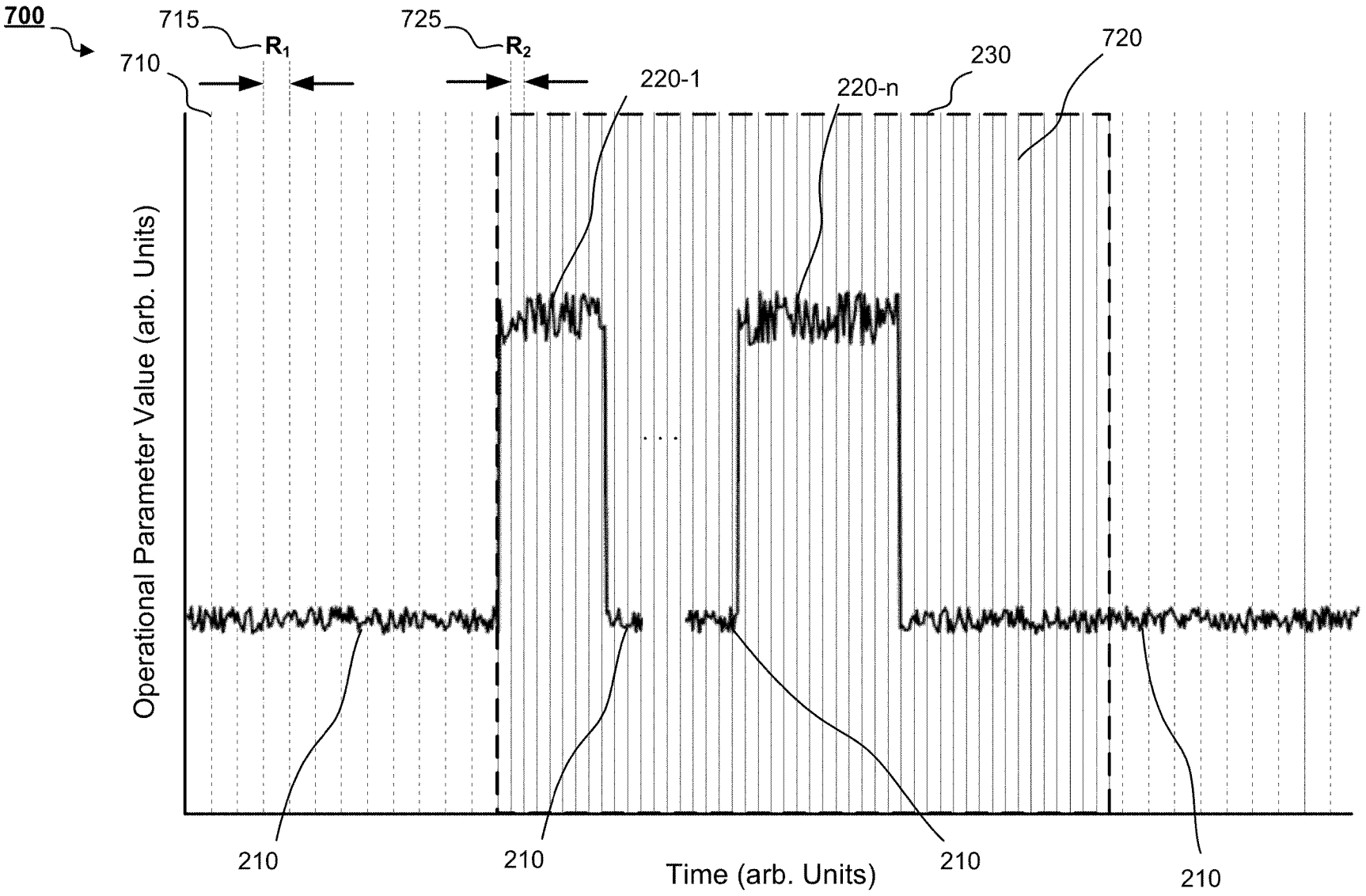

FIG. 7 schematically illustrates an example control signal 700 where a baseline sampling rate $R_1$ 715 and a measurement sampling rate $R_2$ 725 are superimposed on top of the example control signal 700 for illustrative purposes. The baseline sampling rate $R_1$ 725 corresponds to a sampling rate outside of a time window 230 (e.g., before a triggering of a start of the time window 230) of a control signal according to the present technique at which processing circuitry, such as the processing circuity 510 shown in FIG. 5, for example, may sample an output of one or more sensors operable to sense an operational parameter of a drill string, such as the one or more sensors 520 shown in FIG. 5, for example. Similarly, the measurement sampling rate $R_2$ 725 corresponds a sampling rate inside the time window 230 (e.g., after a triggering of a start of the time window and before expiration of the time window given its predetermined duration). According to the present technique, sampling of the control signal to perform the pulse count is arranged to be resilient to variability in pulse width and successive pulse time variation within the time window. This may be achieved by identifying a rising edge or a falling edge of a pulse or both the rising and the falling edge. This facilitates having variable timings on the pulses and multiple amplitudes. By way of contrast, synchronous techniques for pulse counting may sample on the assumption of a given pulse width and a given pulse occurrence period in a way that does not distinguish between rising and falling edges of a pulse. In fact synchronous techniques may result in multiple counting (e.g. double counting) of a single pulse in the event that the pulse width is longer than the pulse sampling time. By way of contrast, according to the present technique, identifying at least one of a rising pulse edge and a falling pulse edge and an ability to distinguish between the two different edge types, makes inadvertent multiple counting of a single pulse unlikely. Thus the present technique is resilient to variations in pulse width when performing pulse counting making it less prone to error than synchronous pulse counting techniques.

The example control signal 700 corresponds to the example control signal 200 shown in FIG. 2. Accordingly, the above description of the example control signal 200 shown in FIG. 2 is also applicable to the example control signal 700 shown in FIG. 7. For brevity, this disclosure does not provide a full description of the example shown in FIG. 7. The same reference numerals are used for corresponding features of FIG. 2 and FIG. 7.

With reference to FIG. 5 and FIG. 7, outside of the time window 230, the processing circuitry 510 may sample the output of the one or more sensors 520 to sense the operational parameter at the baseline sampling rate R1 715 (as indicated by dot-dash lines 710), while inside the time window 230, the processing circuitry 510 may sample the output of the one or more sensors 520 to sense the operational parameter at the measurement sampling rate $R_2$ (as indicated by solid lines 725), where the baseline sampling rate 715 may be lower than the measurement sampling rate 725. Sampling the output of the one or more sensors 520 outside of the time window 230 may be for the purposes of detecting the start of the time window 230 and may be for recalibration of the baseline. Such tasks may not benefit much from sensor measurements having a particularly high granularity, and therefore, a comparatively low sampling rate may suffice for sampling the output of the one or more sensors 520 outside of the time window. Sampling the output of the or more sensors 520 inside the time window 230 may be for the purpose of detecting a number of pulses of the operational parameter, based on which a control command may be determined. To accurately detect the number of pulses of the operational parameter it may desirable to utilise a higher sampling rate than that which would suffice for triggering the time window or for baseline recalibration purposes. By utilising the baseline sampling rate $R_1$ 715 (e.g., outside the time window 230) which may be lower than the measurement sampling rate $R_2$ 725, the processing circuitry 510 may more accurately determine the number of pulses of the operational parameter in the time window and yet save power due to the relatively low sampling rate outside the time window 230 in comparison to examples where only one sampling rate is used both inside and outside the time window 230.

Referring back to FIG. 5, the power source 540 may provide electrical power to any active (e.g., powered) components comprised within the controller 500, including, for example, the processing circuitry 510, and the memory 525 (when present). The power source 540 may optionally provide electrical power to the one or more sensors 520 in examples where the one or more sensors 520 comprise at least one active sensor. The power source 540 may also power the actuator 530.

The power source 540 may comprise a battery or a plurality of batteries, or any other type of power source. A power management algorithm or circuitry may be implemented to reduce an operational power of at least one of the processing circuitry, the sensor(s), the memory 515,525 and the actuator 530 when appropriate.

Figure 8:
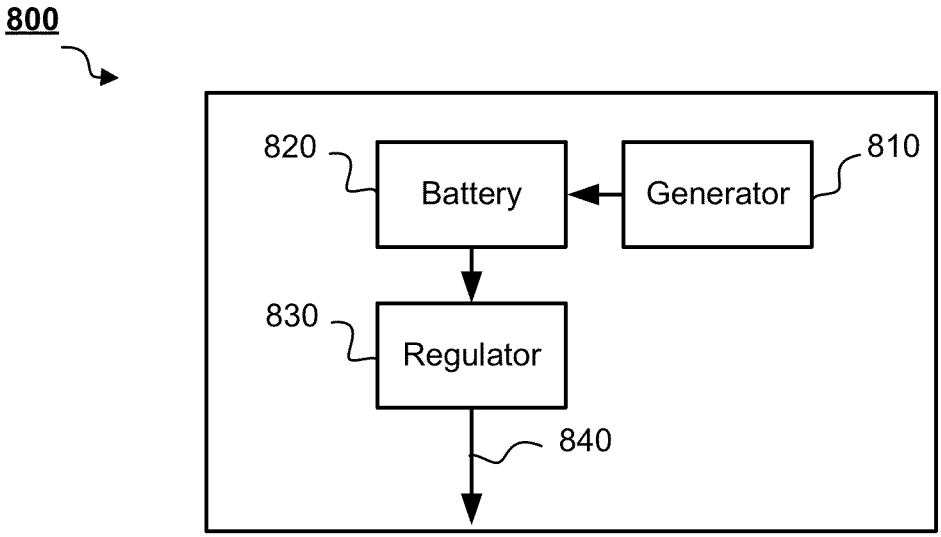

FIG. 8 schematically illustrates an example power source 800 for powering a controller to control a downhole tool, such as, for example, the controller 115 shown in FIG. 1, the controller 500 shown in FIG. 5, or any other controller operable to control a downhole tool in accordance with the present technique.

The example power source 800 comprises an electrical generator 810, a battery 820 and a regulator 830. In some examples, the power source 800 may be comprised within a downhole tool. In other examples the power source 800 may be otherwise coupled to, or form part of a drill string comprising a downhole tool to be controlled.

The electrical generator 810 may convert mechanical energy (e.g., associated with the operation of the drill string e.g., associated with movement of the drill string itself, such as, for example, rotation of the drill string, or motion of drilling fluid being pumped through the drill string) into electrical energy for powering a controller which is to control a downhole tool. The electrical generator 810 may comprise any type of generator including, but not limited to a turbine generator, a vibrational energy harvester, a thermal electrical generator and a fixed displacement motor.

The electrical generator 810 may be electrically coupled to the battery 820, which may comprise a rechargeable battery or a plurality of rechargeable batteries having any battery cell chemistry, including but not limited to: lead-acid; Nickel-cadmium; lithium-ion or any other rechargeable battery cell chemistry.

The electrical generator 810 may be coupled to the battery 820 via interface circuitry (not shown) which may, for example, convert the output of the electrical generator from alternative current (AC) to direct current (DC). Additionally or alternatively, the interface circuitry may control the charging of the battery in accordance with a battery charging protocol depending on a cell chemistry of the battery 820. For example, if the battery 820 were to utilise a lithium ion battery, the interface circuitry may control the charging of the battery in accordance with a lithium ion battery charging cycle comprising e.g., trickle charge, constant current charge, contest voltage charge and charge termination phases.

The regulator 830 may comprise one or more voltage regulators which may regulate the voltage output from the battery 820 to a voltage level 840 or a plurality of voltage levels 840 suitable for powering any active components of a controller operable to control a downhole tool in accordance with the present technique, such as, for example, the controller 500. The voltage levels 840 may correspond to different processor power levels as controlled via the power management algorithm.

Figure 9:
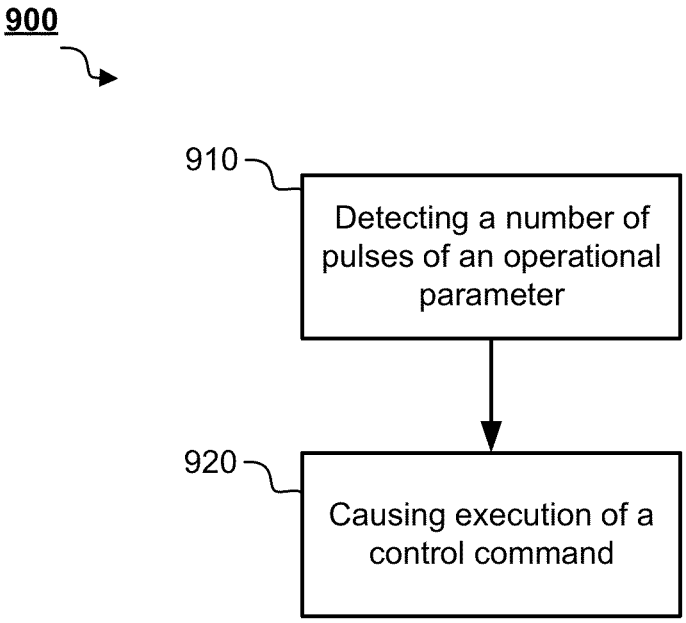
FIG. 9 is an example flowchart schematically illustrating controlling a downhole tool.

FIG. 9 depicts a flow chart 900 schematically illustrating controlling a downhole tool comprised within a drill string. The downhole tool may comprise, for example, the downhole tool 114 shown in FIG. 1 or any other downhole tool. Flow chart 900 may be performed by, for example, a controller operable to control a downhole tool, such as, for example, the controller 115 shown in FIG. 1, the controller 500 shown in FIG. 5.

At block 910, an operational parameter of a drill string comprising a downhole tool is sensed to detect a number of pulses of the operational parameter within a time window having a predetermined duration. The operational parameter may comprise any operational parameter, including, for example: a rotational speed of the drill string; a pressure of fluid in the drill string; a flow rate of fluid through the drill string; a longitudinal axial movement of the drill string; or any other operational parameter of a drill string. The number of pulses of the operational parameter may be comprised within a control signal conveying a control command for controlling the downhole tool. Example control commands include on, off, open and close. The control signal may comprise, for example, the example control signal 200, the example control signal 300, the example control signal 400, or any other control signal in accordance with the present technique.

At block 920, execution of a control command to control the downhole tool may be caused depending on the detected number of pulses of the operational parameter in the time window of the control signal. The detected number of pulses of the operational parameter may be mapped to a corresponding control command. The mapping between the detected number of pulses and the corresponding control command may be in accordance with any example disclosed herein. The control command executed may further depend on at least one of: the type of operational parameter sensed; the polarity of one or more of any pulses detected in the time window; a relative ordering of pulses that vary in polarity; a further operational parameter. Where execution of the control command depends on values of two or more operational parameters, the value of the further operational parameter may or may not be based on a further pulse count. For example, a combination of a pressure above a given pressure threshold and a pulse count of a drill string rotation measurement exceeding a pulse count threshold may trigger execution of a first type of command whereas a combination of a pressure below a given pressure threshold and a pulse count of a drill string rotation measurement exceeding a pulse count threshold may trigger execution of a second type of command. Measurements and detections of two or more types of operational parameter in a given time window may be performed in parallel or in series.

Figure 10:
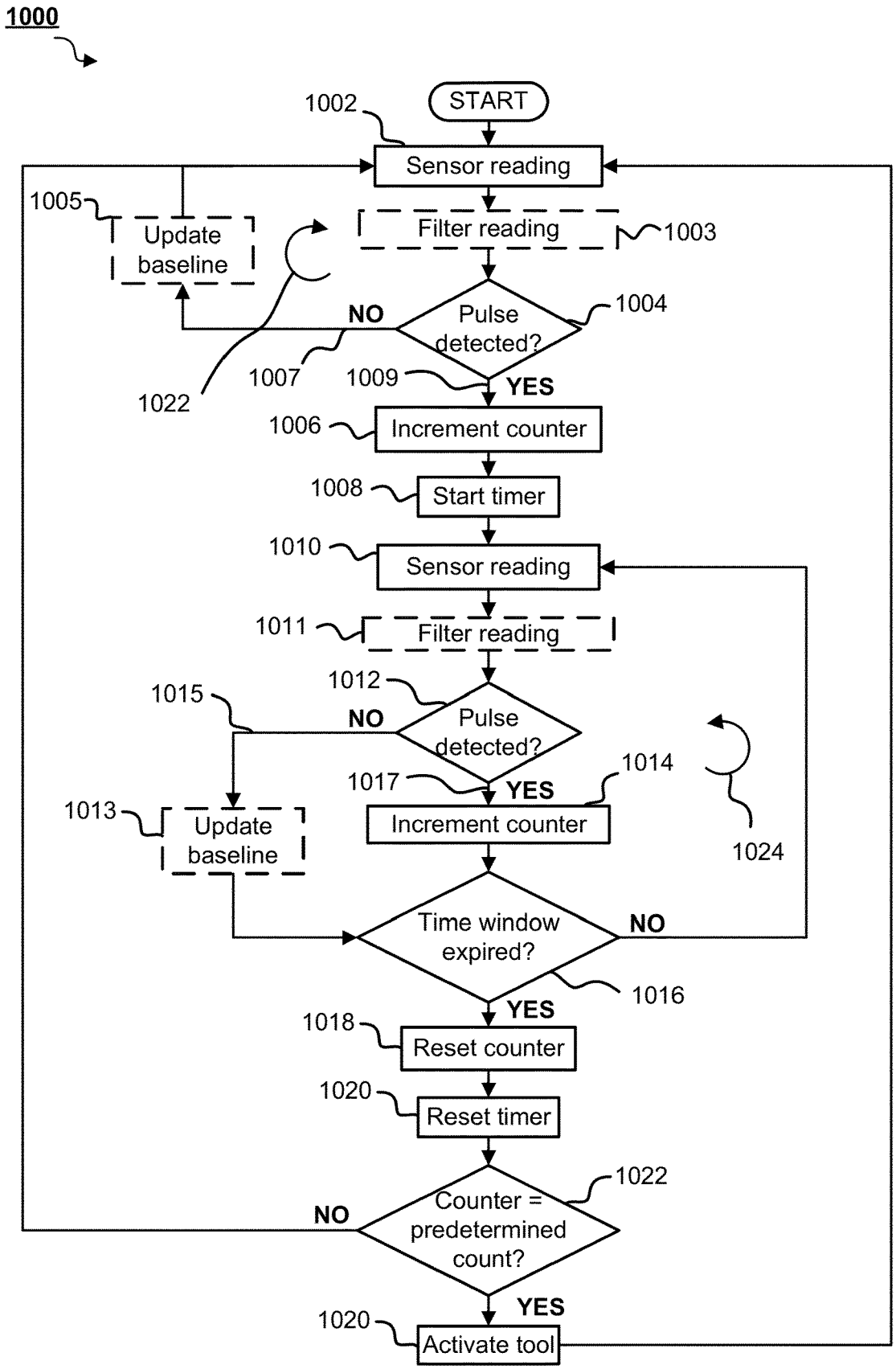
FIG. 10 is a flow chart schematically illustrating how a downhole tool of a drill string is activated depending on sensor readings.

FIG. 10 is a flow chart 1000 schematically illustrating controlling a downhole tool comprised within a drill string. The downhole tool may comprise, for example, the downhole tool 114 shown in FIG. 1 or any other downhole tool. The method of the flow chart 1000 may be performed by, for example, a controller operable to control a downhole tool in accordance with the present technique, such as the controller 115 shown in FIG. 1, or the controller 500 shown in FIG. 5. The method of the flow chart 1000 may provide for the sensing of an operational parameter of a drill string comprising a downhole tool to detect a number of pulses of the operational parameter within a time window having a predetermined duration. The operational parameter may comprise any operational parameter, including, for example: a rotational speed of the drill string; a pressure of fluid in the drill string; a flow rate of fluid through the drill string; a longitudinal axial movement of the drill string; or any other operational parameter of a drill string. The number of pulses of the operational parameter may be comprised within a control signal conveying a control command for controlling the downhole tool. The control signal may comprise, for example, the example control signal 200, the example control signal 300, the example control signal 400, or any other control signal in accordance with the present technique.

At block 1002, a sample of sensor data is obtained from one or more sensors arranged to sense the operational parameter of the drill string. The sample may be indicative of a value of the operational parameter of the drill string (e.g., at a corresponding sampling time). The one or more sensors may comprise any type or types of sensors operable to sense the operational parameter directly or indirectly, in accordance with examples disclosed herein. On each iteration of block 1002, the corresponding obtained sample may be stored to enable, for example, at subsequent iterations of the flow chart 1000, one or more historical samples to be used for e.g., filtering or baseline calibration purposes, as will be described further below.

The flow chart 1000 optionally includes block 1003. In examples where block 1003 is present, the flowchart 1000 may proceed to block 1003 from block 1002. In other examples, block 1003 may not be present and the flowchart may proceed to block 1004 from block 1002.

At block 1003, the sample obtained at block 1002 is filtered to reduce noise prior to the detection of a pulse of the operational parameter at block 1004. The sample may be filtered using any type of filter operable to reduce noise, including, but not limited to, a low pass filter and a rolling average filter. The filtering performed at block 1003 may depend on both the sample obtained at block 1002 and one or more historical samples. In examples where a rolling average filter is implemented at block 1003, the rolling average filter may be configured to generate an unweighted mean of k samples comprising the sample obtained at block 1002 and k−1 historical samples. On a first iteration of the block 1003, the one or more historical samples may have been obtained from a previous sensor measurement session. On subsequent iterations of block 1003, the historical samples may comprise either: one or more samples obtained during previous iterations of the process e.g., at previous iterations of block 1002 or block 1010; or a combination of historical samples obtained prior to the start of the flow chart 1000 process and one or more samples obtained during previous iterations of the flowchart 1000.

At block 1004, it is determined if the sample obtained at block 1002 (or a filtered variant of the sample i.e., obtained at block 1003, when present) is indicative of a pulse of the operational parameter, based on which a pulse of the operational parameter may be detected. A pulse of the operational parameter may be detected based on identifying any one of: a leading edge of the pulse of the operational parameter (e.g.: a rising edge of a pulse having a positive polarity, the rising edge corresponding to a transition from a baseline value to a value higher than the baseline value; or a falling edge of a pulse having a negative polarity, the falling edge corresponding to a transition from the baseline value to a value lower than the baseline value); a trailing edge of the pulse of the operational parameter (e.g., a falling edge of a pulse having a positive polarity, the falling edge corresponding to a transition from a value higher than the baseline value to the baseline value; or a rising edge of a pulse having a negative polarity, the rising edge corresponding to a transition from the baseline value to a value lower than the baseline value); or both a leading edge and a trailing edge of the pulse of the operational parameter, in accordance with examples disclosed herein. The leading edge and the trailing edge of the operational parameter may comprise a deviation from the baseline value which is greater than or equal to a (e.g., predetermined) threshold magnitude. In some examples, one or both of the leading edge and the trailing edge of the pulse of the operational parameter may be identified by determining that the deviation associated with the respective edge is greater than or equal to the threshold magnitude. An example flow chart of a process that may be performed at the pulse detection 1004 block is described below with reference to FIG. 11.

In some examples, if a pulse of the operational parameter is detected at block 1004, the polarity of the pulse may also be determined at block 1004 e.g., based on the direction and order of the constituent transitions of the pulse relative to the baseline value.

If a pulse of the operational parameter is not detected at block 1004, the flowchart 1000 returns to block 1002, optionally via block 1005 at which the baseline value may be updated based on the sample obtained at block 1002 and e.g., one or more historical samples. The baseline value may be updated in accordance with any example disclosed herein If a pulse is detected at block 1004, the flowchart 1000 proceeds to block 1006 where a pulse counter (e.g., initialised to a value of zero) is incremented, followed by block 1008 where a timer is started (e.g., thereby triggering the start of the time window). In some examples, the value of the pulse counter may be incremented responsive to a pulse of any polarity being detected at block 1004. In other examples, such as where the polarity of the pulse of the operational parameter was determined at block 1004, the pulse counter (or two distinct pulse counters) may count a number of pulses having a positive polarity and a number of pulses having a negative polarity. In these examples, incrementing the pulse counter may comprise incrementing the counter value corresponding to the polarity of pulse detected at block 1004.

At block 1010, a further sample of sensor data from the one or more sensors is obtained. The further sample may be indicative of a further value of the operational parameter of the drill string (e.g., at sampling time subsequent to the sampling time corresponding to the sample obtained at block 1002).

The flow chart 1000 optionally includes block 1011. In examples where block 1011 is present, the flowchart may proceed to block 1011 from block 1010. In other examples, block 1011 may not be present and the flowchart may proceed to block 1012 from block 1010. At block 1011, the further sample obtained at block 1010 is filtered to reduce noise prior to the detection of a pulse at block 1112 e.g., in accordance with any examples disclosed herein.

At block 1012, it is determined if the further sample obtained at block 1010 (or a filtered variant of the further sample e.g., obtained at block 1011, when present) is indicative of a pulse of the operational parameter, based on which a pulse of the operational parameter may be detected. This determination may be in accordance with any example disclosed herein.

If a pulse is detected at block 1012, the polarity of the pulse may also be determined at block 1012 e.g., based on the direction and order of the constituent transitions of the pulse relative to the baseline value.

If a pulse of the operational parameter is not detected at block 1012, the process may proceed to block 1016, optionally via block 1013 in which the baseline value may be updated based on the sample obtained at block 1010 and e.g., one or more historical samples. The baseline value may be updated in accordance with any example disclosed herein.

If a pulse of the operational parameter is detected at block 1012, the flowchart 1000 proceeds to block 1014 at which the pulse counter is incremented. In some examples, an order of any pulses detected at block 1012 relative to any previous pulses detected within the time window e.g., at block 1004 or at previous iterations of block 1012, may be recorded.

At block 1016, it is determined if the time window has expired by comparing the value of the timer to the predetermined duration of the time window.

If the time window has not yet expired, the flow chart 1000 returns to block 1010 to obtain a further sample to determine if any further pulses are present during the time window. If the time window has already expired, the flow chart 1000 proceeds to block 1018, at which the counter is reset, followed by block 1020, at which the timer is reset.

At block 1022 it is determined if there is a mapping between the number of pulses of the operational parameter detected within the time window and a corresponding control command. The mapping may depend on, for example, an absolute number of pulses within the time window or a number of pulses and a polarity of each pulse of the number of pulses in the time window. In some examples, the mapping may depend on an order of the number of pulses of the operational parameter within the time window in view of the polarity of each of the pulses. The mapping may further depend on the particular type of operational parameter such that a different operational parameter is mapped to a different command for the same pulse count for example. The mapping between a pulse count of an operational parameter can a control command may depend on two or more operational parameter values in the time window. An operational parameter value other than a pulse count may be taken into account for the further operational parameter where the command mapping depends on two or more operational parameters.

If, at block 1022, it is determined that there is no such mapping between the number of pulses of the operational parameter detected within the time window and a corresponding control command, the process returns to block 1002 to detect future pulses of the operational parameter in future time windows to cause execution of future control commands. If on the other hand it is determined that such a mapping exists, the flowchart 1000 proceeds to block 1020 where execution of the corresponding control command is caused to control the downhole tool accordingly. Following block 1020, the process returns to block 1002. In some examples, samples of sensor data may obtained at a (e.g., variable) sampling rate. The sampling rate may depend on whether samples are being obtained inside or outside the time window e.g. as described herein. The sampling rate outside the time window may correspond to the rate at which the process 1000 loops through blocks 1002 to 1004 and back to 1002, as indicated by the arrow 1022. This sampling rate may correspond to a baseline sampling rate. The sampling rate inside the time window may correspond to the rate at which the flow chart 1000 loops through blocks 1010 to 1016 and back to 1010, as indicated by the arrow 1024. This sampling rate may correspond to a measurement sampling rate. The baseline sampling rate may be less than the measurement sampling rate to, for example, reduce power consumption outside a time window while providing sufficient measurement granularity during the time window.

Figure 11:
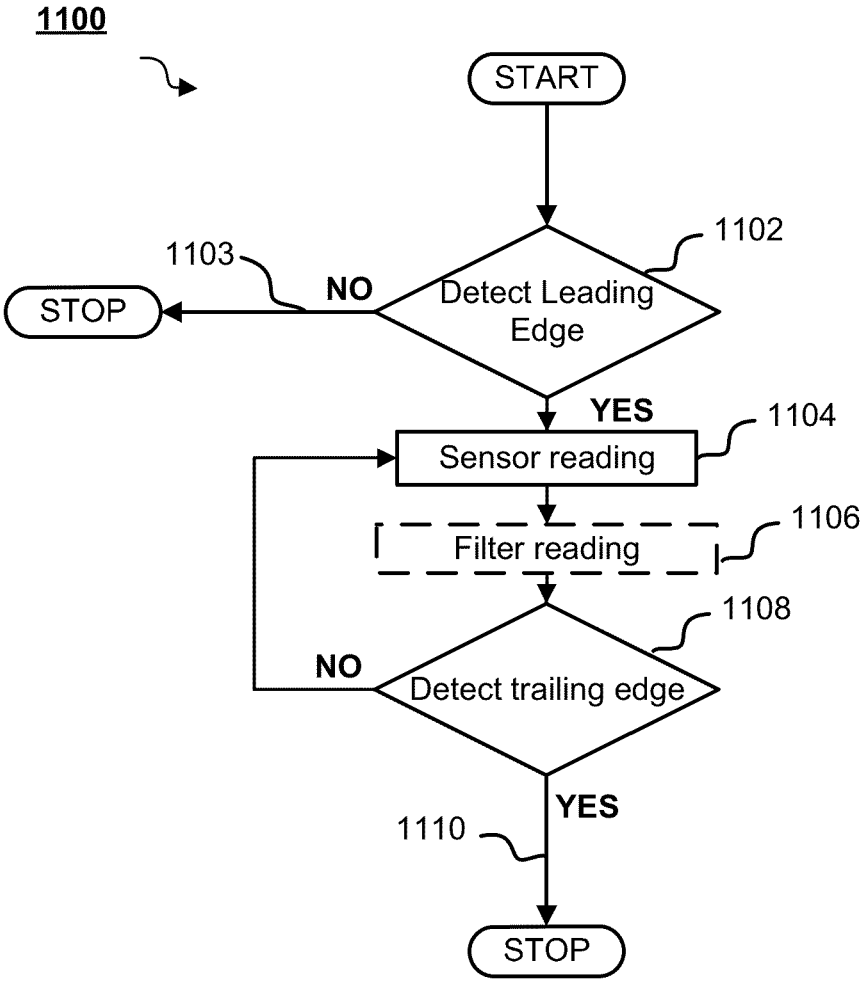
FIG. 11 is a flow chart schematically illustrating identification of a pulse of an operational parameter of a drill string comprising a downhole tool, in which both a leading edge and a trailing edge of the pulse are used for the identification.

While the flowchart 1000 shows certain blocks to occur in a given order, this is merely for illustrative purposes and the present disclosure is not limited to this order. For example, the order of blocks 1006 and 1008 may be reversed i.e., block 1008 may occur before block 1006. As another example, the order of blocks 1018 and 1020 may be reversed i.e., block 1020 may occur before block 1018. Furthermore, the blocks shown in the flowchart 1000 may not be executed sequentially: some may be executed in parallel. As an illustrative example, if at block 1004, a pulse is detected by identifying both the leading and trailing edge of the pulse (e.g., as shown in FIG. 11 described below), one or both of the incrementing of the counter at block 1006 and the starting of the timer at block 1008 may occur during block 1004 e.g., subsequent to the detection of the leading edge of the pulse at block 1004 but prior to the detection of the trailing edge of the pulse at block 1004. Similarly, the incrementing of the counter at block 1014 may occur during block 1012.

While the flowchart 1000 depicts an example where the time window is triggered by a pulse, this is merely for illustrative purposes and the present disclosure is not so limited.

FIG. 11 is a flow chart 1100 schematically illustrating identifying a pulse of an operational parameter of a drill string comprising a downhole tool based on identifying both the leading edge and the trailing edge of the pulse. The flow chart 1100 may correspond to, for example, one or both of the pulse detections performed at block 1004 and block 1012 of the flowchart 1000 shown in FIG. 10.

At block 1102, it is determined if a sample of sensor data indicative of a value of the operational parameter of the drill string (such as for example, the sample obtained at block 1002 or block 1010 of flowchart 1000, respectively) is indicative of a leading edge of a pulse of the operational parameter, based on in which it may be determined if a leading edge has been detected. The presence of the leading edge may be determined in accordance with any example disclosed herein.

If it is determined that the sample is not indicative of a leading edge of a pulse of the operational parameter, then the flow chart takes branch 1103 (which may correspond to, for example branch 1007 or 1015 of flow chart 1000) and it is determined that no pulse of the operational parameter has been detected.

If it is determined on the other hand that the sample is indicative of a leading edge of a pulse of the operational parameter, then flow chart 100 proceeds to block 1104.

At block 1104, a further sample of sensor data is obtained from one or more sensors arranged to sense the operational parameter of the drill string, such as, for example, the one or more sensors arranged to sense the operational parameter of the drill string at blocks 1002 and 1010 of the flowchart 1000. The further sample is indicative of a value of the operational parameter of the drill string (e.g., at a corresponding sampling time). On each iteration of block 1104, the corresponding obtained sample may be stored to enable, for example, their subsequent use at e.g., filtering block 1006 (when present).

The flow chart 1100 optionally includes block 1106. In examples where block 1106 is present, the flowchart may proceed to block 1106 from block 1104. In other examples, block 1106 may not be present and the flowchart 1100 may proceed to block 1108 from block 1104. At block 1106, the sample obtained at block 1004 is filtered to reduce noise prior to the detection of a trailing edge of a pulse of the operational parameter at block 1108. The sample may be filtered in accordance with any examples disclosed herein.

At block 1108, it is determined if the sample obtained at block 1104 (or a filtered variant of the sample e.g., obtained at block 1106, when present) is indicative of a trailing edge of the pulse of the operational parameter, based on in which it may be determined if a trailing edge has been detected. The presence of the trailing edge may be determined in accordance with any example disclosed herein.

If it is determined that the sample is not indicative of a trailing edge of a pulse of the operational parameter, then the flow chart reverts to block 1104 to obtain further samples. In other words, the flowchart 1100 loops through blocks 1104 to 1108 until a trailing edge of the operational parameter, and therefore, a complete pulse of the operational parameter is detected. While not shown in FIG. 11, the flowchart 1100 may comprise e.g., break points operable to break the above-mentioned loop based on, for example a given number of loop iterations exceeding a timeout threshold.

If it is determined that the sample obtained at block 1104 (or its filtered variant) is indicative of a trailing edge of a pulse of an operational parameter, the flow chart 1100 takes branch 1110 (which may correspond to, for example, branch 1009 or 1017 of flow chart 1000) and it is determined that a pulse of the operational parameter has been detected.

According to the present technique, a method, apparatus and computer program are provided for efficiently and effectively communicating with one or more downhole tools to execute control commands to control the operations of the downhole tool(s) in situ in a wellbore below the Earth's surface. Such a downhole environment presents particular communication challenges such as, for example, making wireless communication with a downhole tool using a wireless control protocol challenging or infeasible. Although control commands may be communicated to downhole tools by, for example, using predetermined variations in a rotational speed of the drill string 110 or predetermined changes in pressure of fluid being pumped down the drill string by the pump 150, such measurements that rely on sensors measuring absolute values of pressure or rotational speed are highly error prone. The error may arise, for example, as a result of drift due temperature or general drift over time such as could be attributable to hysteresis from soldering. Furthermore, pressure has a tendency to increase with a depth of the wellbore 120 and changes depending on mud weights, pressure and stick-slip of the drill string 110. This means that, in practice, control calibration using absolute values for sensor measurements such as rotational speed and pressure and any changes in those values to infer a control command can be highly error prone.

Thus according to the present technique, an asynchronous time-based approach is implemented that allows for variability in absolute values of sensor measurements of an operational value and also allows for variability in the duration of any deviation from baseline values of the operational value that can arise in the course of communicating the control signal from the Earth's surface (e.g. via one or both of the pump 150 and the rotator 140) down the wellbore 120. A baseline value of the operational parameter is measured for calibration purposes and a threshold is defined to quantify any deviations from the baseline value that are to be associated with a feature of a control signal for triggering a control command to operate a downhole tool. This technique of conveying control commands provides resilience to inevitable variations in absolute values of sensor readings when measuring an increment in a variable such as pressure or speed initiated via the pump 150 or the rotator 140, the variations arising due to the harsh downhole conditions rather than being due to intended changes in the control values themselves.

The technique also provides resilience to variations in timing of control pulses arising due to the measurement environment. Timing between successive pulses is considered to be less important than the total number of pulses within the predetermined time period associated with the pulse count. There is inherent variability in pulse transmission for apparatus such as mud pumps and rotary tables used to control downhole tools. This timing resilience and sensed value variation resilience when interpreting control commands conveyed remotely (e.g. from the Earth's surface to the bottom of the wellbore) makes the technique well-adapted for downlinking in a wellbore.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C).

Embodiments of the inventions are described by the following numbered examples.

According to a first example a method of controlling a downhole tool is provided, the method comprising:

sensing an operational parameter of a drill string comprising the downhole tool, the sensing to detect a number of pulses of the operational parameter within a time window having a predetermined duration, a pulse corresponding to a period during which the operational parameter deviates from a baseline value, wherein the detection of the number of pulses accommodates at least one of a variable pulse duration and a variable pulse magnitude within the time window; and causing execution of a control command to control the downhole tool depending on the detected number of pulses of the operational parameter.

Example 2 is the method of example 1, wherein a pulse of the operational parameter comprises a deviation by at least a threshold magnitude between a baseline value and a value different from the baseline value.

Example 3 is the method of example 2, wherein the operational parameter comprises one or more of: a rotational speed of the drill string; a pressure of fluid in the drill string; a flow rate of fluid through the drill string; and a longitudinal axial movement of the drill string.

Example 4 is the method of any one of examples 1 to 3, wherein the control command executed depending on the number of pulses of the operational parameter differs depending on the particular operational parameter being sensed.

Example 5 is the method of any one of examples 1 to 4, wherein execution of the control command depending on the detected number of pulses of the operational parameter further depends on a sensed value of at least one further operational parameter.

Example 6 is the method of example 5, wherein the sensed value of the at least one further operational parameter is a value other than a number of sensed pulses of the second operational parameter.

Example 7 is the method of any one of examples 1 to 6, wherein a first time window in which the operational parameter is sensed is triggered by detection of a first pulse following initiation of the pulse count by a processing circuit.

Example 8 is the method of any one of examples 1 to 7, wherein a first pulse of the operational parameter following a preceding time window triggers a start of a next time window in which the number of pulses is detected.

Example 9 is the method of any one of examples 2 to 8, wherein a magnitude of a difference between the baseline value and the value different from the baseline value exceeds a predetermined threshold magnitude.

Example 10 is the method of any one of examples 1 to 10, further comprising recalibrating the baseline value periodically or intermittently.

Example 11 is the method of any one of examples 1 to 10, wherein the sensing comprises sampling sensor data at a variable or at a constant sampling rate.

Example 12 is the method of example 11, wherein the sampling rate is variable and wherein the sampling rate outside the time window comprises a baseline sampling rate, and wherein the sampling rate during the time window comprises a measurement sampling rate.

Example 13 is the method of example 12, wherein the baseline sampling rate is less than the measurement sampling rate.

Example 14 is the method of any one of examples 10 to 13, wherein the recalibrating of the baseline value comprises:

sampling the operational parameter of the drill string either periodically or intermittently; and determining one of: an average value of the operational parameter based on a predetermined number of samples of the operational parameter; a minimum value of the operational parameter of a predetermined number of samples.

Example 15 is method of any one of examples 1 to 14, wherein the number of pulses of the operational parameter comprises either: pulses of a given polarity; or pulses of different polarities.

Example 16 is the method of example 15, wherein a polarity of a pulse of the operational parameter comprises either a positive polarity or a negative polarity.

Example 17 is the method of example 16, wherein:

a pulse of the operational parameter comprising a positive polarity comprises: a pulse of the operational parameter having a first transition away from the baseline value of the operational parameter to a value greater than the baseline value and a second transition back towards the baseline value of the operational parameter.

Example 18 is the method of example 16 or example 17, wherein:

a pulse of the operational parameter comprising a negative polarity comprises: a pulse of the operational parameter having a first transition away from the baseline value of the operational parameter to a value less than the baseline value and a second transition back towards the baseline value of the operational parameter.

Example 19 is the method of any one of examples 1 to 18, wherein the command further depends on a polarity of at least a subset of the number of pulses in the time window.

Example 20 is the method of example 19, wherein the command depends on an order of the number of pulses of the operational parameter in the time window, each pulse of the number of pulses having a respective polarity.

Example 21 is the method of any one of examples 1 to 20, wherein the downhole tool is any one of: a circulating sub; an underreamer; a casing scraper; a variable gauge stabiliser; a line hanger; a whipstock; a rotary steerable system; a drill string isolation tool; a jetting tool; a magnet; a filter; a swivel; a mill; a brush; a venturi; and a disconnect tool.

Example 22 is the method of any one of examples 1 to 21, wherein the operational parameter is sensed by any one of: a tachometer; an accelerometer; a hall effect sensor; a photoelectric sensor; a magnetometer; a gyroscope; a strain gauge; a pressure sensor; any combination thereof.

Example 23 is the method of any one of examples 1 to 22, wherein the downhole tool has a plurality of modes.

Example 24 is the method of example 23, wherein the plurality of modes comprises one or more of: an activated mode; a deactivated mode; a delayed activation mode; a delayed deactivation mode; an isolation mode; and one or more intermediate modes.

Example 25 is the method of either one of examples 23 or 24, wherein the command is to invoke a first mode of the plurality of modes.

Example 26 is the method of either one of examples 23 or 24, wherein the command is to invoke a transition from a current mode of the plurality of modes to a different mode of the plurality of modes.

Example 27 is the method of example 26, wherein the different mode is predetermined depending on the current mode.

Example 28 is the method of any one of examples 1 to 27, wherein the downhole tool is a first downhole tool of a plurality of downhole tools, and wherein the drill string is couplable to the plurality of downhole tools.

Example 29 is the method of example 28, wherein the number of pulses of the operational parameter used to cause execution of the control command upon detection in the time window, is either:

uniquely associated with the first downhole tool; or uniquely associated with a subset of downhole tools of the plurality of downhole tools including the first downhole tool.

Example 30 is the method of any one of examples 1 to 29, wherein the drill string is a casing string or a liner string.

Example 31 is machine-readable instructions which when executed by processing circuitry cause the processing circuitry to perform the method of any one of examples 1 to 30.

Example 32 is a program product comprising the machine readable instructions of example 31.

Example 33 is an apparatus for a control of a drill string having at least one downhole tool, the apparatus comprising;

a memory to store a mapping of a number of pulse counts of an operational parameter pulse to a corresponding control command for one or more of the least one downhole tool; and processing circuitry to:

process sensor measurements to detect a number of pulses of an operational parameter of the drill string within a time window having a predetermined duration, wherein a pulse corresponds to a period during which the operational parameter deviates from a baseline value and wherein the detection of the number of pulses is resilient with respect to at least one of any variability in pulse duration and any variability in pulse magnitudes within the time window; and cause execution of a control command to control the downhole tool depending on the detected number of pulses of the operational parameter and the stored mapping.

Example 34 is the apparatus of example 33, wherein the stored mapping maps different control commands to different operational parameters and wherein the control command executed depending on the detected number of pulses of the operational parameter further depends on the given operational parameter.

Example 35 is the apparatus of example 33 or example 34, wherein the processor is arranged to discriminate between a rising edge and a falling edge of the pulse to provide the resilience of the number of pulses detected to variability in at least one of pulse duration and pulse magnitude.

Example 36 is the apparatus of any one of examples 33 to 35, wherein the drill string is a casing string or a liner string Example 37 is a downhole drilling system comprising:

a drill string;

at least one downhole tool connected to the drill string; and the downhole tool control apparatus of any one of examples 33 to 36.

The invention claimed is:

1. A method of controlling a downhole tool, comprising the steps of:

sensing an operational parameter of a drill string comprising the downhole tool, the sensing to detect a number of pulses of the operational parameter within a time window having a predetermined duration, a pulse corresponding to a period during which the operational parameter deviates from a baseline value, wherein the detection of the number of pulses accommodates at least one of a variable pulse duration and a variable pulse magnitude within the time window;

wherein the sensing comprises sampling sensing data at a sampling rate;

wherein the sampling rate is a variable sampling rate; and wherein the sampling rate outside the time window comprises a baseline sampling rate, and wherein the sampling rate during the time window comprises a measurement sampling rate; and causing execution of a control command to control the downhole tool depending on the detected number of pulses of the operational parameter.

2. The method of claim 1, wherein the operational parameter comprises one or more of:

a rotational speed of the drill string;

a pressure of fluid in the drill string;

a flow rate of fluid through the drill string; and a longitudinal axial movement of the drill string.

3. The method of claim 1, wherein the control command executed depending on the number of pulses of the operational parameter differs depending on the particular operational parameter being sensed.

4. The method of claim 1, wherein execution of the control command depending on the detected number of pulses of the operational parameter further depends on a sensed value of at least one further operational parameter.

5. The method of claim 4, wherein the sensed value of the at least one further operational parameter is a value other than a number of sensed pulses of the second operational parameter.

6. The method of claim 1, wherein a first time window in which the operational parameter is sensed is triggered by detection of a first pulse following initiation of a pulse count by a processing circuit.

7. The method of claim 1, wherein a first pulse of the operational parameter following a preceding time window triggers a start of a next time window in which the number of pulses is detected.

8. The method of claim 1, further comprising the step of:

calibrating a baseline value periodically or intermittently.

9. The method of claim 8, wherein the calibrating of the baseline value comprises:

sampling the operational parameter of the drill string either periodically or intermittently; and determining one of:

an average value of the operational parameter based on a predetermined number of samples of the operational parameter;

a minimum value of the operational parameter of a predetermined number of samples.

10. The method of claim 1, wherein the baseline sampling rate is less than the measurement sampling rate.

11. The method of claim 1, wherein the number of pulses of the operational parameter comprises either:

pulses of the operational parameter of a given polarity; or pulses of the operational parameter of different polarities.

12. The method of claim 11, wherein a polarity of a pulse of the operational parameter comprises either a positive polarity or a negative polarity.

13. The method of claim 1, wherein the control command further depends on a polarity of at least a subset of the number of pulses in the time window.

14. The method of claim 13, wherein the control command depends on an order of the number of pulses of the operational parameter in the time window, each pulse of the number of pulses having a respective polarity.

15. A non-transitory machine-readable medium comprising instructions which when executed by processing circuitry cause the processing circuitry to perform the method of claim 1.

16. An apparatus for a control of a drill string having at least one downhole tool, the apparatus comprising;

a memory to store a match between a number of pulse counts of an operational parameter pulse to a corresponding control command for one or more of the least one downhole tool; and a processing circuitry configured to:

process sensor measurements to detect a number of pulses of an operational parameter of a drill string within a time window having a predetermined duration, wherein a pulse corresponds to a period during which the operational parameter deviates from a baseline value and wherein the detection of the number of pulses is resilient with respect to at least one of any variability in a pulse duration and any variability in a pulse magnitude within the time window; and cause execution of a control command to control the downhole tool depending on the detected number of pulses of the operational parameter and the stored match, wherein the processing circuitry is operable to sample an output of one or more sensors to sense the operational parameter at a sampling rate;

wherein the sampling rate is a variable sampling rate; and wherein the sampling rate outside the time window comprises a baseline sampling rate, and wherein the sampling rate during the time window comprises a measurement sampling rate.

17. The apparatus of claim 16, wherein the stored match maps different control commands to different operational parameters and wherein the control command executed depending on the detected number of pulses of the operational parameter further depends on the given operational parameter.

18. The apparatus as claimed in claim 16, wherein the processor is configured to discriminate between a rising edge and a falling edge of the pulse to provide the resilience of the number of pulses detected to variability in at least one of the pulse duration and the pulse magnitude.

19. A method of controlling a downhole tool, comprising the steps of:

sensing an operational parameter of a drill string comprising the downhole tool, the sensing to detect a number of pulses of the operational parameter within a time window having a predetermined duration, a pulse corresponding to a period during which the operational parameter deviates from a baseline value, wherein the detection of the number of pulses accommodates at least one of a variable pulse duration and a variable pulse magnitude within the time window; and causing execution of a control command to control the downhole tool depending on the detected number of pulses of the operational parameter;

calibrating the baseline value periodically or intermittently.

20. The method of claim 19, wherein the calibrating of the baseline value comprises the steps of:

sampling the operational parameter of the drill string either periodically or intermittently; and determining one of: an average value of the operational parameter based on a predetermined number of samples of the operational parameter; a minimum value of the operational parameter of a predetermined number of samples.

* * * * *